US006439147B2

(12) United States Patent
Cottrell et al.

(10) Patent No.: US 6,439,147 B2
(45) Date of Patent: Aug. 27, 2002

(54) MOORING SYSTEMS WITH ACTIVE FORCE REACTING SYSTEMS AND PASSIVE DAMPING

(75) Inventors: Roy H. Cottrell, Cypress; L. Terry Boatman; Yonghui Liu, both of Houston, all of TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/756,644

(22) Filed: Jan. 9, 2001

Related U.S. Application Data

(60) Provisional application No. 60/175,150, filed on Jan. 7, 2000.

(51) Int. Cl.[7] ..... B63B 21/00

(52) U.S. Cl. ..... 114/230.19; 114/230.1

(58) Field of Search ..... 114/230.1, 230.13, 114/230.14, 230.12; 701/230.15–230.19, 230.21, 230.22, 21

(56) References Cited

U.S. PATENT DOCUMENTS

| | | | | |
|---|---|---|---|---|
| 3,008,158 A | | 11/1961 | Stinson | |
| 3,863,590 A | | 2/1975 | Karl et al. | |
| 3,886,887 A | * | 6/1975 | Cunningham et al. | 114/230.1 |
| 3,916,812 A | | 11/1975 | Bartels | |
| 3,961,490 A | | 6/1976 | Corgnet | |
| 4,290,158 A | | 9/1981 | Kuntz, Jr. | |
| 4,309,955 A | | 1/1982 | Kentosh | |
| 4,396,046 A | | 8/1983 | Kentosh | |
| 4,493,282 A | | 1/1985 | Ortloff | |
| 4,494,475 A | | 1/1985 | Eriksen | |
| 4,530,302 A | | 7/1985 | Pedersen | |
| 4,532,879 A | | 8/1985 | Ortloff | |
| 4,568,295 A | | 2/1986 | Poldervaart | |
| 4,665,856 A | | 5/1987 | Pedersen | |
| 4,694,771 A | | 9/1987 | Poldervaart et al. | |
| 4,735,167 A | | 4/1988 | White et al. | |
| 4,784,079 A | | 11/1988 | Poldervaart | |
| 4,798,155 A | | 1/1989 | Poldervaart | |
| 4,802,432 A | | 2/1989 | Poldervaart et al. | |
| 4,825,797 A | | 5/1989 | Poldervaart et al. | |
| 4,838,823 A | | 6/1989 | De Baan et al. | |
| 4,907,996 A | | 3/1990 | Poldervaart | |
| 4,917,038 A | | 4/1990 | Poldervaart et al. | |
| 5,014,638 A | | 5/1991 | Ilves et al. | |
| 5,243,926 A | | 9/1993 | Wright et al. | |
| 5,361,716 A | | 11/1994 | Cotton | |
| 5,997,374 A | | 12/1999 | Pollack | |

FOREIGN PATENT DOCUMENTS

| | | |
|---|---|---|
| EP | 0798206 A1 | 10/1997 |
| NL | 8602806 | 6/1988 |

* cited by examiner

*Primary Examiner*—Ed Swinehart
(74) *Attorney, Agent, or Firm*—Gary L. Bush, Esq.; Andrews & Kurth, LLP.

(57) ABSTRACT

A mooring system including a body/arm/vessel arrangement with passive damping and/or an active force restoring system. The active force restoring system includes a sensor for generating a displacement signal representative of the displacement of the vessel from a quiescent position and an active forcing device which responds to the displacement signal to force the arm in a direction to move the vessel toward the quiescent position. The passive damping arrangement includes a device, independent of and in addition to the damping of the water on the vessel or the arm, that damps the oscillation of the vessel in response to environmental conditions which force the vessel from its quiescent position. Hydraulic cylinder arrangements are provided for active forcing and passive damping. Powered winch/cable arrangements are also provided for active force systems. Alternative devices for active and passive damping systems of torque actuators include hydraulic powered cans with internal fins, or cans with internal elastomeric elements or disk brake elements.

80 Claims, 17 Drawing Sheets

FIG. 1
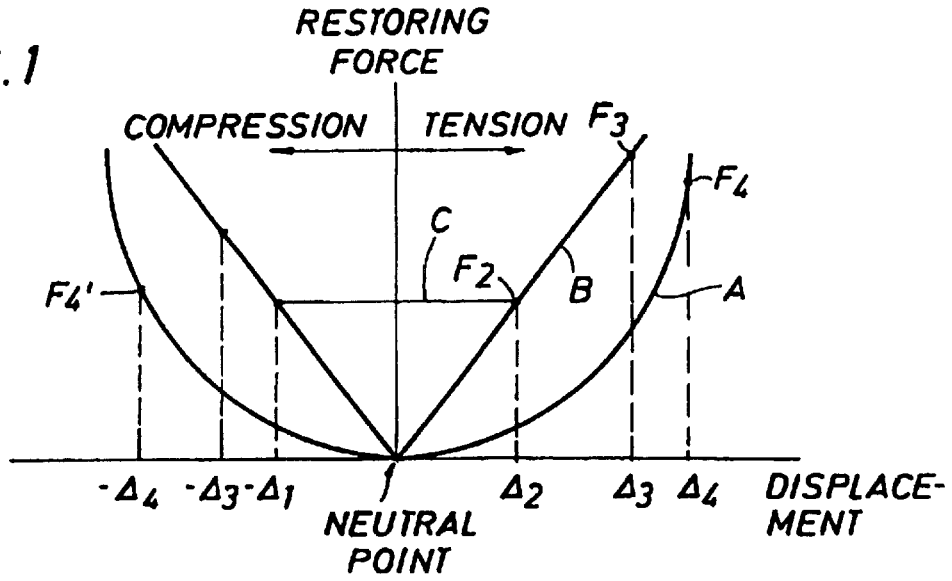
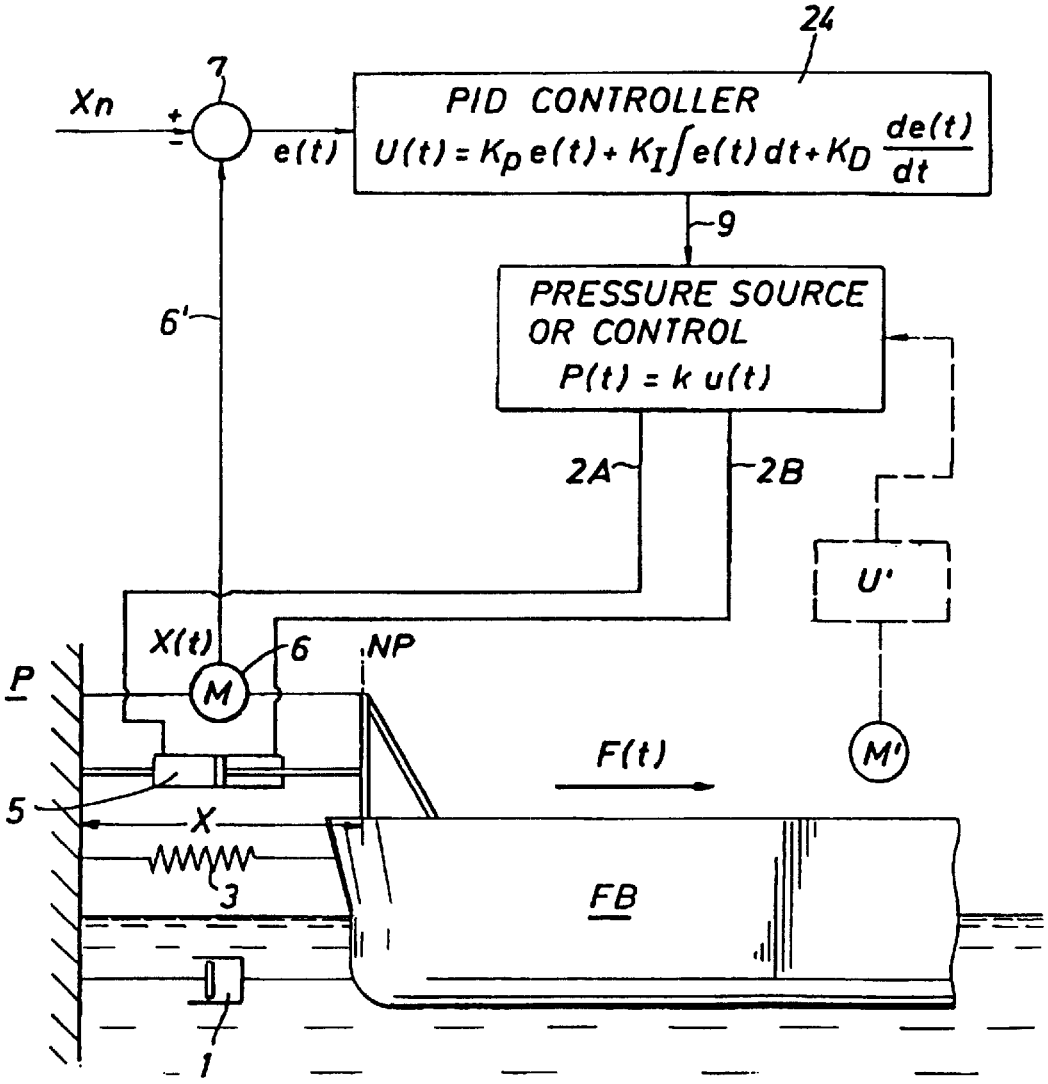
FIG. 2C

FIG. 24
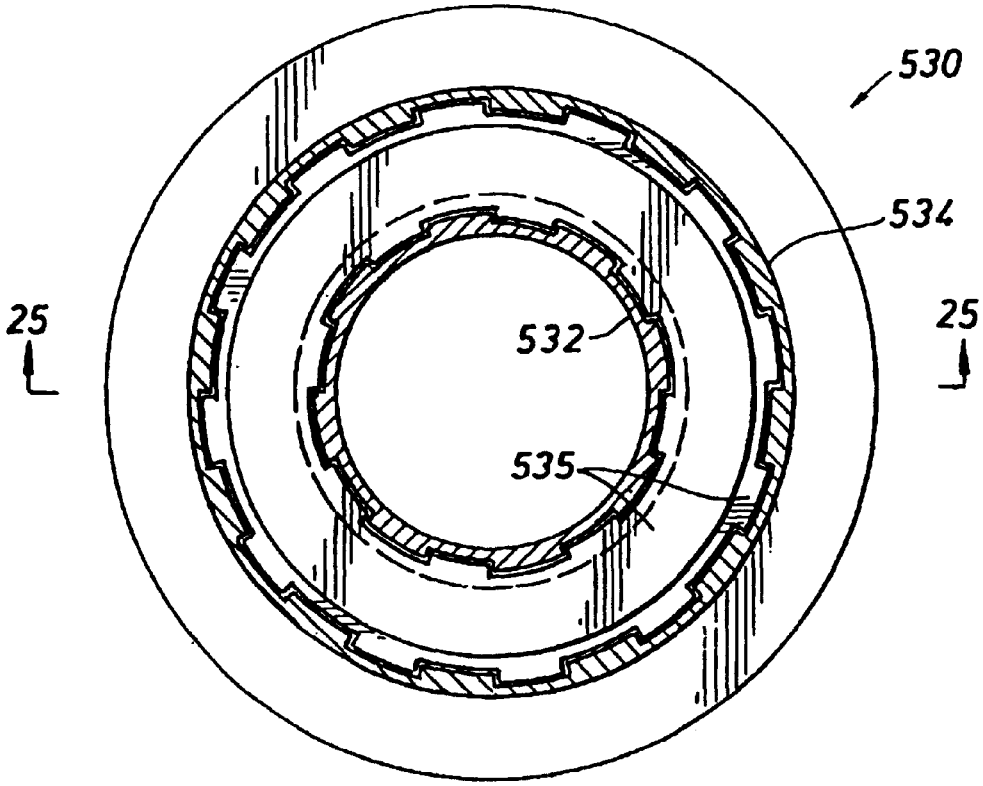
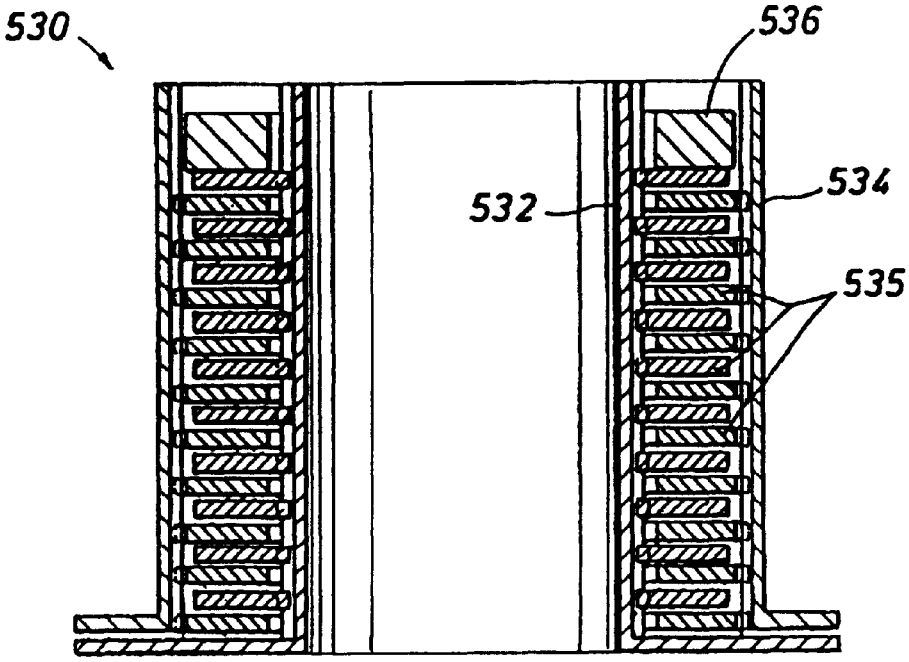
FIG. 25

MOORING SYSTEMS WITH ACTIVE FORCE REACTING SYSTEMS AND PASSIVE DAMPING

CROSS REFERENCE TO RELATED APPLICATION

This Non-Provisional Application claims priority from Provisional Application 60/175,150 filed on Jan. 7, 2000.

BACKGROUND OF THE INVENTION

1. Field of the Invention

This invention relates generally to the field of mooring arrangements for vessels, particularly offshore vessels such as Floating Production and Offloading Vessels (FPSOs) or Floating Storage and Offloading vessels (FSOs) used in offshore hydrocarbon production. Still more particularly, the invention concerns active and passive damping arrangements for yoke/spring systems and yoke/pendulum systems which are spring-like to restore a vessel toward an equilibrium position with respect to a generally stationary body such as a tower or an anchored buoy.

2. Description of the Prior Art

There are numerous examples of yoke arrangements that couple a vessel to a body such as a tower or an anchored buoy or other generally stationary body. U.S. Pat. No. 4,290,158 shows a mooring yoke for a vessel which is coupled for rotation with a turntable on the top of the buoy. U.S. Pat. No. 4,309,955 shows a mooring yoke having two outer ends pivotably coupled to a vessel and having a counter weight on the yoke ends positioned outwardly beyond the coupling point of the vessel. U.S. Pat. No. 4,396,046 illustrates a yoke coupled between a mooring buoy and a vessel, where the yoke provides a base for a fluid conduit between a swivel on the buoy and fluid conduits on the vessel. U.S. Pat. No. 4,516,942 illustrates a yoke placed between a tower and a vessel, where ends of the two outer arms of the yoke are connected to the vessel by cables. Weights are positioned in the outer ends of the yoke arms, such that the yoke acts much like an undamped spring or a pendulum between the vessel and the tower. Dutch Patent 8602806 shows disconnectable yoke arms suspended from a tower. U.S. Pat. No. 4,530,302 shows a subsea yoke having its outer arms suspended by cables from the vessel. An enhanced pendulum effect is achieved by weight in the outer arms. The movement of the cables in the water increases damping of the spring effect of the weighted yoke arms. U.S. Pat. No. 4,665,856 shows a yoke coupled between a vessel and a tower. Weights are suspended from yoke arms near the tower. U.S. Pat. No. 4,694,771 also shows a yoke coupled between a vessel and a tower. Pendulum weights are provided on the yoke arms at their coupling to the tower. U.S. Pat. No. 4,568,295 shows a yoke positioned between an anchored buoy and a vessel, with the outer ends of the yoke arms suspended from the vessel and with a weight positioned on the yoke so that a pendulum arrangement is provided which acts like an undamped spring between the buoy and the vessel. U.S. Pat. No. 4,784,079 shows a tower-supported yoke suspended from a frame of a vessel with a pendulum weight provided at the end of the yoke arms. U.S. Pat. No. 4,917,038 shows a tower supported submerged yoke with quick-action couplings for disconnection. A weight at the end of the yoke suspended from cables or rods from the vessel causes the yoke to act like a pendulum or undamped spring, but the water acting on the suspension members and yoke damps the spring-like system more than if the yoke were entirely above water. U.S. Pat. No. 4,825,797 show other submerged yoke mooring systems.

The prior art described above provides mooring systems for vessel position control by relying on the deflection of a mechanical system to generate a spring-like restoring force, especially for tower/yoke systems. The damping of the tower-yoke-vessel systems arises primarily through friction of the vessel as it moves through the water in an oscillatory manner when environmental forces cause the vessel to move against its yoke.

Other mooring systems of course exist and all mooring systems can be generally categorized according to the type of restoring force produced as SALM or TLP systems, CALM systems or tower/yoke systems. In a SALM or TLP arrangement, the angular deflection of mooring legs result in inward mooring leg tension and an included angle to create a restoring force. In a CALM system, deflection of mooring legs increases mooring tension to produce a restoring force. In a tower/yoke system, deflection of pendular or spring systems results in a restoring force.

All three of the mooring categories described above have the following characteristics:

(1) The spring-like restoring forces are reactive and for that reason are not applied to the vessel until the vessel motion passes through the neutral or quiescent point;

(2) The damping force in the system is a small percentage of the spring-like restoring force; and (3) As a consequence, momentum load on the mooring system is often a significant component of peak restoring loads, especially in body-yoke-vessel systems such as tower/yoke mooring systems.

In all of the stationary body-yoke-vessel arrangements described above, a mathematical model of a spring positioned between a stationary body and a movable body is appropriate with a small damping element placed in series with the spring. The stationary body is modeled as a fixed point. The mass of the movable body, i.e., the vessel, is very large. The momentum of the vessel causes it to move through the neutral point of the yoke and to move to the other side of it due to the system's inherent lack of energy dissipation, and because the counter restoring force of the system cannot be generated until the vessel passes through the neutral or quiescent point to the other side. The natural damping force of the vessel moving through the water is not enough to prevent oscillatory motion of the vessel.

In other words, if a vessel is disturbed by wind, waves and current to a position away from its mooring neutral position, it obtains a potential energy with respect to the mooring devices which support it from a stationary point. The vessel is returned toward its neutral point with its potential energy converted into kinetic energy with the speed of the vessel increasing at the neutral point. This kinetic energy, if there is little or no damping in the mooring system, must be absorbed or converted into potential energy on the opposite side of the neutral point which requires greater vessel excursion or displacement from the neutral point than would be necessary in a mooring system with greater damping.

3. Identification of Objects of the Invention

A primary object of the invention is to provide an active "forcing system" or active damping system by which excursions of a vessel past a neutral point of a yoke of a stationary body-yoke-vessel system are opposed by an active controlled restoring force. By applying such controlled force, displacement amplitudes of the vessel can be reduced or even eliminated, with the result that the overall size, weight and cost of the mooring system can be reduced.

Another object of the invention is to provide a passive damping system by which vessel oscillations past the neutral point are rapidly damped with the result that extreme displacement amplitudes of the vessel, that is amplitudes of the oscillation, are significantly reduced or even critically damped, with the result that a smaller system can be provided with reductions in size, weight and cost.

Another object of the invention is to provide a tower-yoke-vessel arrangement in which maximum displacement amplitudes of the vessel are small enough so that a product flow line from the tower to the vessel needs no supporting frame such as the yoke itself, but rather can be run from the top of the tower to the vessel.

Another object of the invention is to provide an arrangement by which forces are produced to control the motion of the vessel substantially independently of its displacement position magnitude from the mooring quiescent point.

Another object of the invention is to provide damping in a body-arm-vessel system through the use of pressure control devices coupled between the body and the arm or between the arm and the vessel.

SUMMARY OF THE INVENTION

The objects identified above, as well as other features and advantages are realized in several alternative embodiments of the invention described herein. An active damping system is provided in several embodiments where a signal is produced which is proportional to the displacement of the vessel from a neutral position of a body-yoke-vessel system. The signal controls the direction and magnitude of force of a cylinder linked to the yoke for applying a force to it in a direction opposite to that of its present motion.

A passive damping system is provided in other embodiments by which a damping hydraulic cylinder is applied in the yoke arms or arm so as to provide automatic passive damping force to a yoke with its ends connected directly to the vessel.

The invention includes arrangements with redundant cylinders by which both active and passive damping can be provided for a mooring arrangement. Components other than hydraulic cylinders can be used to achieve active and passive damping. Possible alternatives include brake shoes on linearly sliding structures or on rotating disks or drums all of which provide a damping force only. Cables from winches or drums are used in an active restoring force arrangement and/or a damping force. Electrical linear activators provide a restoring force and/or damping force. Elastomeric elements provide restoring and damping characteristics.

One embodiment of the invention includes a tower with a submerged yoke coupled to the tower and to the vessel. The tower includes a top section with a fluid swivel mounted on its top. Fluid conduits extend to the vessel from the tower-mounted swivel without the benefit of support from the submerged yoke.

BRIEF DESCRIPTION OF THE DRAWINGS

FIG. 1 is a restoring force vs. displacement graph which illustrates the alternative arm/yoke mooring systems of the invention including a pendulum soft yoke system, a passive stiff spring system and an active system using a feedback control system and force producing cylinder or other mechanism to restore a vessel toward its mooring neutral point;

FIG. 2C is a more detailed schematic diagram of a PID feedback control system for actively forcing the vessel back to its neutral point;

FIGS. 24 and 25 illustrate a brake pad damping arrangement to provide damping resistance to angular motion in place of the torque activators of FIGS. 19 and 20;

DESCRIPTION OF PREFERRED EMBODIMENTS OF THE INVENTION

Figure 2B:
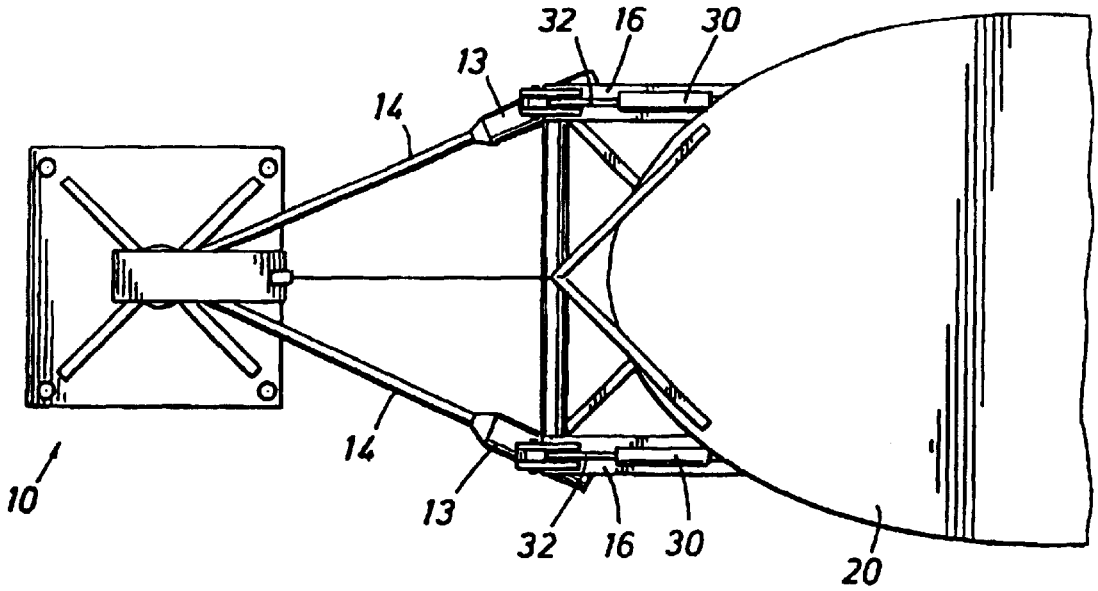
FIGS. 2A and 2B illustrate in side and top views a yoke mooring system including a feedback control system to actively force the vessel back to its neutral point.

Soft yoke mooring systems rely on restoring forces generated by linkages connected to pendular weights. As a result, the restoring force is sinusoidal with displacement as shown in curve "A" of FIG. 1. FIG. 1 is a restoring force versus displacement diagram showing restoring force as a function of displacement of a yoke from a vessel. The neutral or quiescent point is the position of the yoke when the vessel is at rest. Because the restoring force for displacements about the neutral point is so low (essentially zero), soft yoke systems i.e. pendular yoke systems as illustrated by curve A require relatively large displacements to generate the required restoring force and absorb kinetic energy. This characteristic requires large linkages and weights which implies high cost of steel structures. Because there is little damping, peak compression loads toward the tower of a magnitude of ⅚ of peak tension loads away from the tower are seen. For example, the compression restoring force, for a negative displacement of $-\Delta_4$ at F4' is approximately ⅚ as large as F4 for tension restoring forces for a $+\Delta_4$ displacement. The area under Curve "A" (pendular system) between the neutral point and the restoring force point $F_4$ of maximum displacement $\Delta_4$ represents the work or energy stored in the restoring system.

FIG. 1 shows in Curve "B" that if a linear spring were provided, rather than a pendulum yoke system, a linear force versus displacement relationship results. With a linear restoring spring, the area under the "B" curve from the neutral point to the $\Delta_3$ point can equal the same area under the "A" curve but at a reduced displacement. As a result, the size of the mooring linkages can be reduced (with a reduction of the cost of steel structures) where a linear restoring spring is used as compared to a pendulum yoke system.

As mentioned above, the area under each of Curves A, B, C represents work or energy. The energy under the pendular Curve A and the spring Curve B is stored energy and can only be dissipated through vessel motion through the water and is zero at their neutral point.

Further improvement is obtained with an active system, illustrated by Curve "C", where a constant magnitude restoring force is applied to the linkage system. Restoring force is a constant magnitude as a function of displacement. The area under the curve C represents dissipated energy which is applied to retard vessel motion at any position along the displacement curve including at the neutral point. Alternative restoring force curves, other than a constant curve C, may result from an optimum active feedback force system. Even shorter displacements are required of the yoke arms and linkages with an even further reduction of the cost of steel structures. Alternative embodiments, based on the concepts of FIG. 1 of using a PID controller for a constant (or non-constant) restoring force, and using a spring/damping system for a variable restoring force are presented below.

Alternative 1—Active Damping System

The invention is embodied not only in tower systems or submerged arm/yoke turntable assemblies at the structure or body, but also in mooring buoys coupled to above sea surface turntables.

Figure 2A:
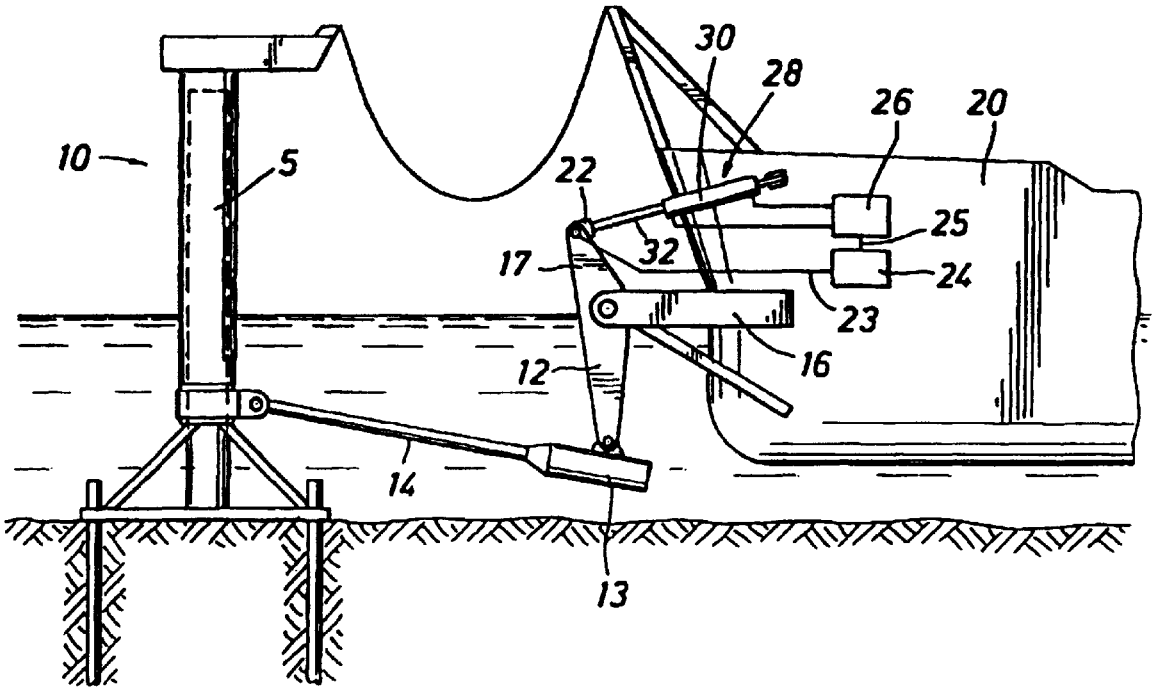

FIGS. 2A and 2B illustrate vessel 20 and a tower-submerged yoke arrangement 10 which includes rocker arms 12 from which the ends of the yoke arms 14 are pivotably suspended. Pendular weights 13 may be provided on the ends of yoke arms 14. Each rocker arm 12 is pivotably coupled to a vessel support member 16. The top extension 17 of the rocker arm 12 rotates toward the tower 5 when the vessel 20 moves toward the tower in response to an environmental disturbance (such as wind, current or waves) and vice versa. The angular position of the rocker arm top extension 17 is proportional to the vessel excursion from a neutral position. An angular position sensing device 22 is installed on the rocker arm 12. The sensing device 22 generates a signal on lead 23 which is representative of the rocker arm 12 position measured from neutral position. That signal is applied to a Proportional Integral and Derivative Controller (PID Controller 24) which generates a control signal on lead 25 to a pressure source and logic circuit 26 for controlling application of pressurized hydraulic fluid to a cylinder-arm arrangement 28 coupled between the rocker arm top extension 17 and the vessel 20. The arrangement includes a cylinder/piston 30 and arm 32. When the rocker arm top extension 17 pivots toward the tower 51, the hydraulic piston/cylinder 30 is forced in a direction to pull the arm 32 toward the vessel 20 in order to oppose counter-clockwise motion of the top extension 17 of the rocker arm 12. When the rocker arm extension 17 pivots toward the vessel 20, the PID Controller 24 acts to cause the hydraulic cylinder/piston 30 to move in a direction to push the arm 32 away from the vessel 20 in order to oppose clockwise motion of the top extension 17 of the rocker arm 12.

In general terms, the arrangement of FIGS. 2A and 2B is an active force restoring system where a motion opposing force is applied to the yoke arms 14 when a position away from a neutral position is sensed. A PID Controller 24 (or any equivalent negative feedback automatic control system) provides a feed back signal to hydraulic cylinders to force the vessel back toward a neutral position.

In theory, the pendular weight 13 is not necessary, because motion resistance is provided by the active negative feedback automatic control system with the hydraulic mechanisms described above. However, the arrangement of FIGS. 2A and 2B is preferred in that the weights 13 on the ends of the yoke arms provide a pendulum restoring force with natural damping due to their submerged position in the water. Such natural damping is in addition to the damping force of the vessel 20 moving in the water. The active damping system as described above adds active return force to the system such that with properly sized hydraulic piston/cylinders 30 and rocker arm 12 lengths and arm lengths 32, only small excursions from the neutral position are experienced in response to environmental forces on the vessel. The arrangement of FIGS. 2A and 2B can alternatively be configured without active control so that passive damping is achieved by using a damping piston/cylinder 24 without a PID Controller or pressure source.

FIG. 2C presents a more detailed description of the feedback system described above. The mathematical model of a mooring system between a geostationary point or axis (such as a tower, or a CALM, etc.) includes a mechanism between a vessel and the geostationary point which is spring like. That mechanism may include a yoke-pendulum mass arrangement or a yoke-torsion spring arrangement and the like. A damping force is also associated with the spring. Such damping is inherently in any mechanical system, such as a yoke-pendulum system. Schematically, damping is modeled as a dash pot 1 which produces a restoring force as a linear function of velocity of the floating body with respect to the stationary point P. The spring force of the mechanism is modeled as a spring 3 between the floating body FB and the stationary point P. The spring 3 produces a restoring force which is linearly proportional to the displacement of the vessel from its neutral position. According to the invention, an active system for providing restoring force in the form of an actuator 5, placed between the vessel FB and the stationary point P is provided either in substitution for the spring 3 and dash pot 1 or in combination with same. A position sensor 6 measures displacement x from the vessel with respect to a neutral point NP from the geostationary point P. The displacement signal x(t) on lead 6' is compared to the neutral or desired position $x_n$ by comparator 7 to produce an error signal e(t) for application to the PID controller 24. The Proportional-Integral-Derivative (PID) controller 24 generates an output control signal u(t) on lead 9 as a function of constants $K_P$, $K_I$, $K_D$ which respectively multiple the error signal, its integral and its derivative with respect to time. A time modulated hydraulic pressure p(t) is generated on lines 2A, 2B as a function of the control signal u(t). A positive hydraulic pressure is applied via lead 2A to one end of actuator 5 and a hydraulic pressure is applied to an opposite end of actuator 5, when u(t) is a negative value. Active control forces applied to the vessel FB cause it to move only small distances in the face of disturbances of wind, waves and current which tend to move the vessel toward or away from the geostationary point.

Alternatively, a system in which a measurement m' of wind, wave and current forces produces a control function u' as indicated by the dashed lines of FIG. 2C, which could preposition the vessel in anticipation of the arrival of the forces generated thereby.

Alternatively, the actuator could be an electrical/mechanical actuator such as a motor driven screw or the like.

Alternative 2—Passive Damping System

Figure 3B:
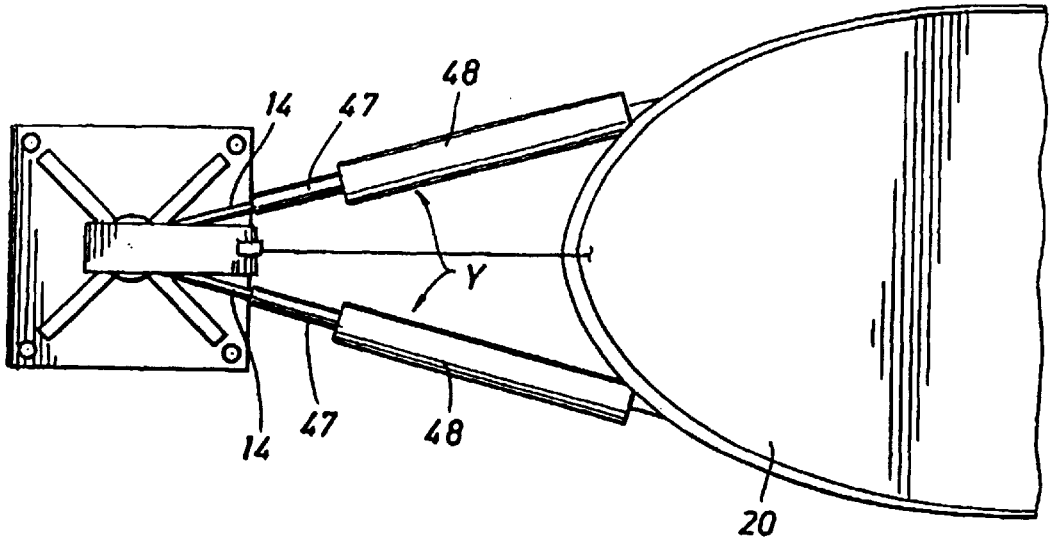
FIGS. 3A and 3B illustrate in side and top views a spring-damping system installed in the arms of a yoke between a tower and a vessel.
Figure 3A:
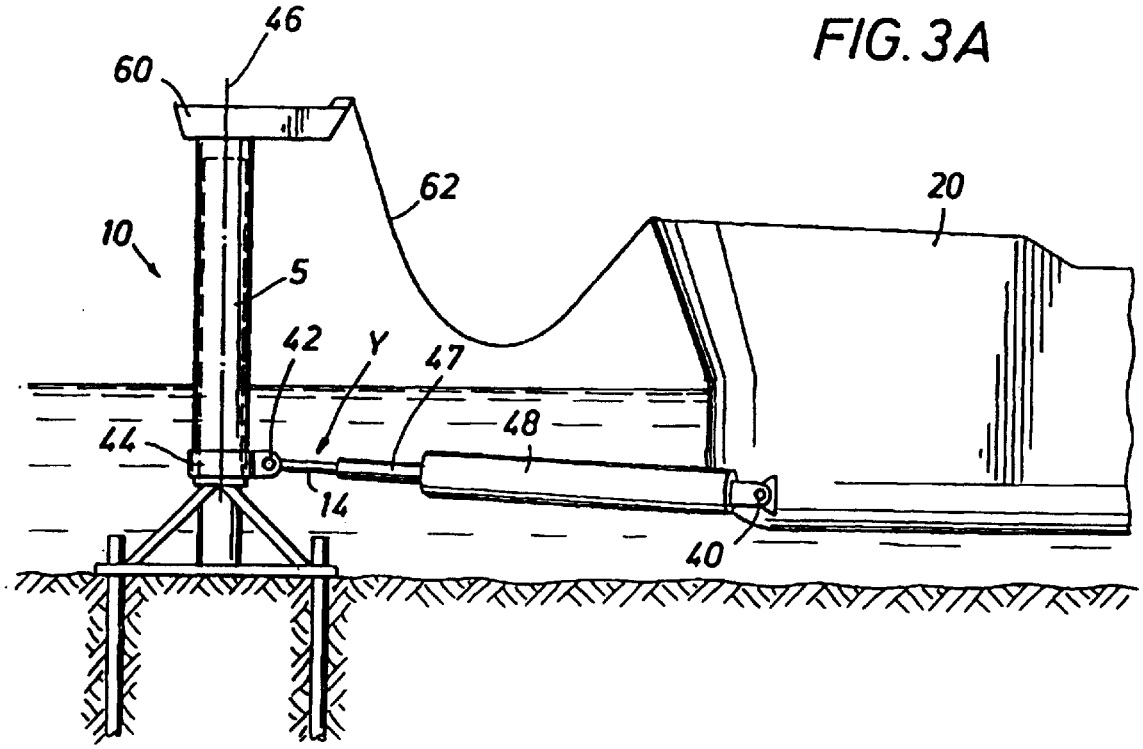

The arrangement of FIGS. 3A and 3B provides a tower-submerged yoke combination 10 which couples a vessel 20 to a mooring body such as a tower 5 or anchored buoy (not illustrated) or the like. Although the embodiment of the invention calls for a submerged yoke Y, the yoke Y can alternatively be arranged to be entirely above the water or partially above and partially below the water. The yoke Y includes yoke arms 14. In the arrangement of FIGS. 3A and 3B, the ends of the yoke arms 14 are coupled to the vessel 20 by means of hydraulic cylinders 47 which are coupled to foam filled neutrally buoyant 48 struts which in turn are connected to the vessel by pivots 40. The yoke arms are also pivotably connected by means of pivots 42 to a turntable 44 at the tower 5. In other words, the yoke Y is free to rotate about the vertical axis 46 of the tower, and a universal pivot 42 is provided so that the yoke can pivot with respect to the tower due to surge and roll motions of the vessel. A hydraulic cylinder 47 assembly is placed in each yoke arm 14 to provide a direct spring restoring force and damping to reduce vessel motion due to environmental forces. In other words, a large spring and damper mechanism 47 is placed in each of the yoke legs 14. In the arrangement of FIGS. 3A and 3B, cylinder 47 preferably include springs, and damping hydraulic pressure is passively applied through orifices and check valves as described below with reference to FIG. 4, or through PID Control over metering valves. Such a PID Control arrangement is similar to that described above by reference to FIG. 2A. Alternatively, vessel position is maintained by hydraulic pressure only (i.e., without the arrangement of FIG. 4), controlled by a PID Controller which controls a pressure source and metering valves. Again, such a PID Control arrangement is similar to that described above by reference to FIG. 2A.

Figure 4:
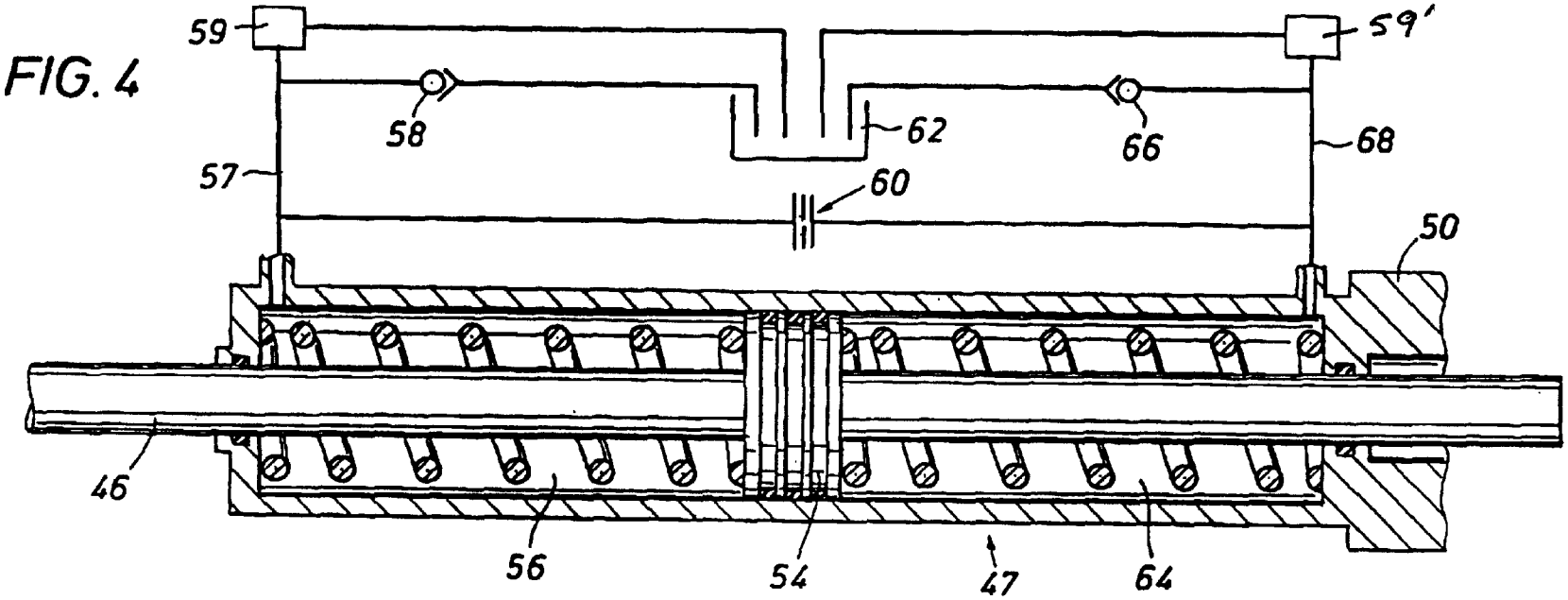
FIG. 4 illustrates the hydraulic cylinder of FIGS. 3A, 3B and which includes a piston-rod arrangement including a spring for forcing the piston toward a neutral position and a hydraulic damping arrangement to minimize mooring system oscillations.

FIG. 4 is a schematic diagram of the hydraulic cylinder 47 that is positioned in the yoke arms 14 as illustrated in FIGS. 3A and 3B. A hydraulic cylinder 47 having an outer housing 50 which is connectable via struts 48 to the vessel 20 is provided. (See FIG. 3A.) A spring loaded rod 46 runs through the cylinder with a piston 54 positioned at a neutral force position within the cylinder. Vessel roll is accommodated in that the rod 46 is free to rotate within the housing 50.

If the vessel 20 pulls away from the turntable 44, the fluid in the right chamber 64 is forced out through the right line 68. As the check valve 66 on the right side of the cylinder is closed to flow from the right, fluid is forced through the damping orifice 60 which results in a back pressure in the right chamber 64 resisting motion and absorbing kinetic energy. If the rate of motion is high, pressure in the right chamber 64 may exceed a pre-set limit and the right relief valve 59' will allow additional fluid to flow to the reservoir.

At the same time, the left chamber 56 is expanding in volume which is fed by fluid through the damping orifice 60. If the right relief valve 59' has allowed the passage of fluid to reservoir 62, the flow from the damping orifice 60 will not be sufficient to keep the left chamber 56 full of oil. The negative pressure created by this lack of oil will be compensated by flow from the reservoir tank 62 through the left check valve 58 and left line 57 into the left chamber 56.

Once the cylinder reaches its maximum extension, this cycle reverses, resulting in a retardation of motion of the vessel toward the turntable.

Figure 4A:
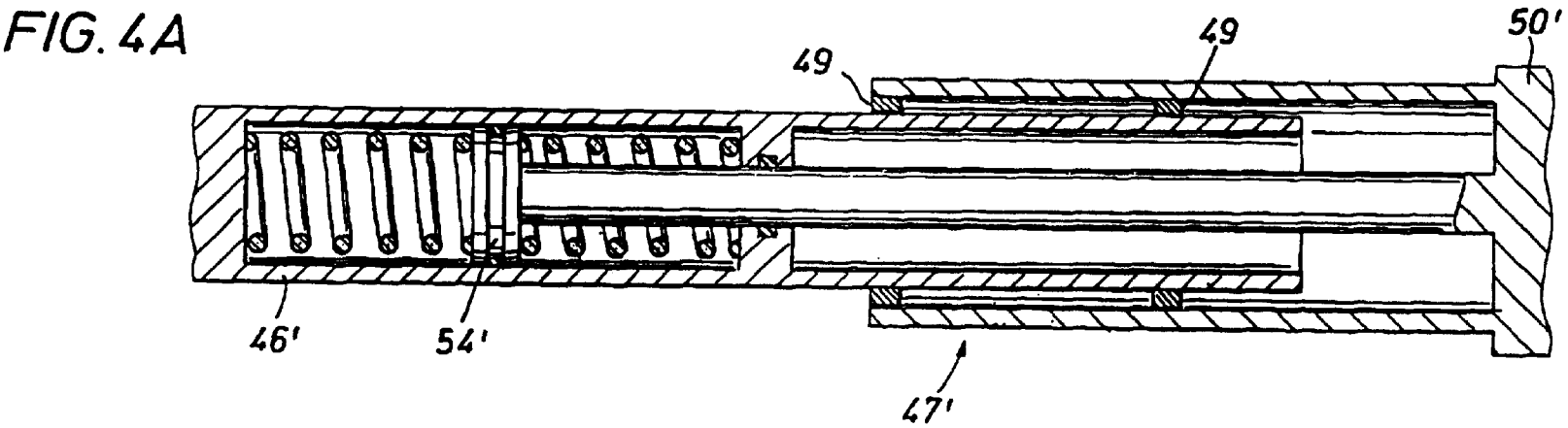
FIG. 4A illustrates an alternative construction of the damping cylinder of FIG. 4.

The schematic drawing of FIG. 4A shows an alternative cylinder arrangement 47' with a tube within a tube construction for lateral stiffness where a structural outer tube 50' provides stiffness for a structural inner tube 46' which reciprocates with the outer tube. The damping cylinder of FIG. 4A is suitable for connection at the tower 10 end, because the sleeve shown resists lateral load. Sliding rings 49 resist lateral loads and moments between the cylinder housing 50' and the rod 46'.

The spring/damping hydraulic cylinder 47 arrangement of FIG. 4 is provided in each of the yoke arms 14 of FIGS. 3A and 3B. Each hydraulic cylinder 47 is coupled to the vessel 20 by means of a foam filled neutrally buoyant strut 48 to reduce side loads on the hydraulic cylinder 47. The piston rod 46 of the cylinder 47 is arranged to rotate about the longitudinal axis of the cylinder 47 to allow for rolling of the vessel due to environmental forces.

The foam filled strut 48 is mounted below the water level of the vessel at an angle to match the wave induced pitch and heave motion of the vessel bow.

It is preferred to mount the yoke Y below water level in order to minimize overturning loads on the tower. Advantageously, a product swivel 60 is mounted on an above-water extension of the tower. Hydrocarbon fluid conduits 62 run from the product swivel 46 to the vessel 20. Because vessel displacements from the tower are not great, due to the spring/damping system of FIGS. 3A, 3B, and 4, and because the yoke Y is mounted below water with the fluid swivel above water, the fluid conduits 62 from the fluid swivel 60 to the vessel 20 do not have to be supported by a ship support superstructure, thereby reducing structure required on the vessel and the tower.

Alternative 3—Horizontal Axis Stiff Yoke Mooring

Figure 5:
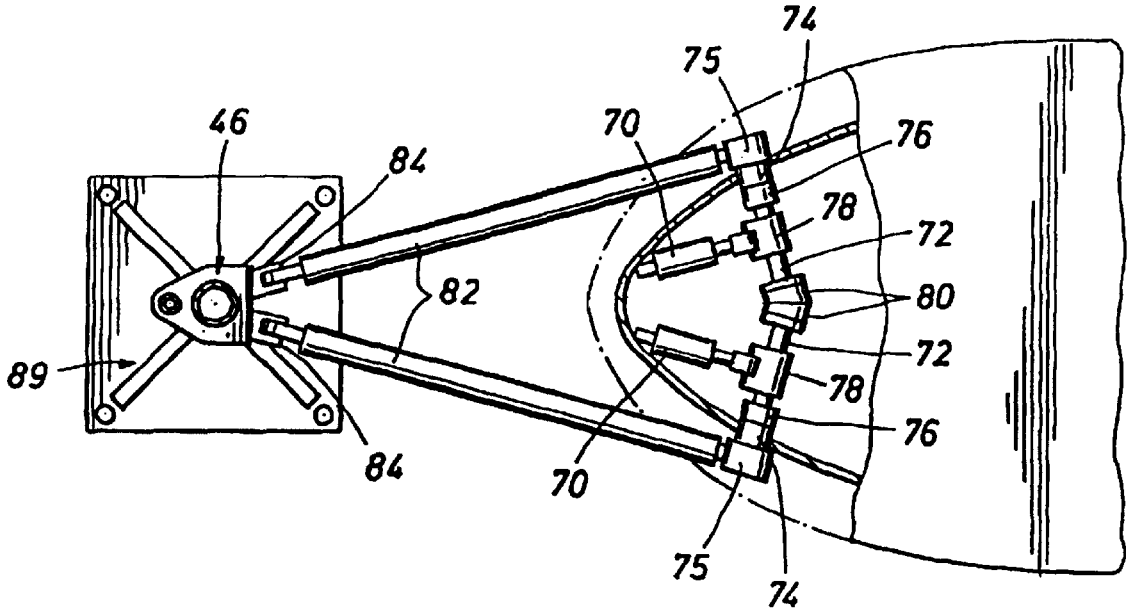
FIGS. 5 and 6 are top and side views of a horizontal shaft axis stiff yoke mooring arrangement with a hydraulic cylinder and active damping system similar to that of FIG. 2A and a redundant hydraulic cylinder and passive damping system similar to that of FIG. 4.
Figure 6:
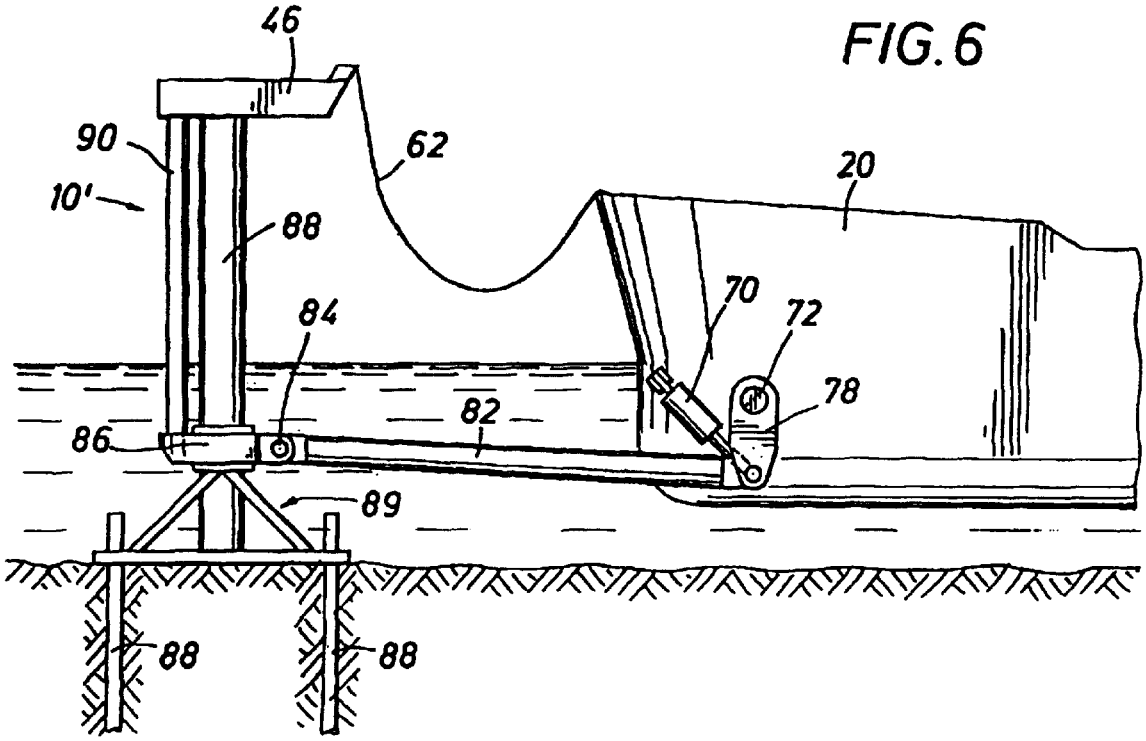

FIGS. 5 and 6 show another arrangement of a yoke mooring system, but with dual redundant hydraulic cylinders 70 of the kind illustrated in FIG. 2A and in FIG. 4. In other words, cylinder 70 may be of the kind like cylinder 28 of FIG. 2A with active damping and including a PID Controller with error signal on deflection. It also may be a passive damping control like that of FIG. 4 with a spring centered damping mechanism with hydraulic pressure relief.

In the FIG. 5 arrangement, two horizontal shafts 72 are installed within the hull of vessel 20. Each shaft 72 penetrates the hull through a water lubricated bearing/outboard 74 and stuffing gland/inboard 76. Each shaft 72 is restrained from rotating by a hydraulic cylinder 70 acting on torque arms 78 attached to the shaft 72. Each shaft 72 has a shaft bearing 80 at its inner most end which primarily resists the radial load of the hydraulic cylinder and secondarily maintains the horizontal position of the shaft 72 relative to the water lubricated bearing 74 at the hull. At the extreme outboard end of each shaft 72, the exterior torque arm 75 connects to a strut 82 connected to goosenecks 84 which are in turn connected to a turntable 86 rotatably supported about vertical shaft 88 of the tower 10. Each strut is coupled to a tower turntable 86 at the lowest practical point to minimize overturning moments and reduce the cost of the piles 88 and tower base 89. The turntable 86 rests on the vertical central shaft 88 which extends upwardly to act as the base for swivel 46, above any potential wave action. The hydraulic cylinders 70 alternatively can be mounted external to the hull via external torque arms 78 in a compact arrangement as illustrated in FIG. 6.

Each of the hydraulic cylinders 70 can be configured in a number of ways. Single or double cylinder/systems may be provided for each cylinder 70. For example, a single active, or a single passive or a mixed active and passive cylinder may be provided. An active system with a PID Controller with error signal generation with vessel movement may be provided like that of FIG. 2A. A passive system like that of FIGS. 4 or 4A may be provided with spring centered, damped and pressure relieved features.

Alternative 4—Vertical Axis Stiff Yoke Mooring

Figure 7:
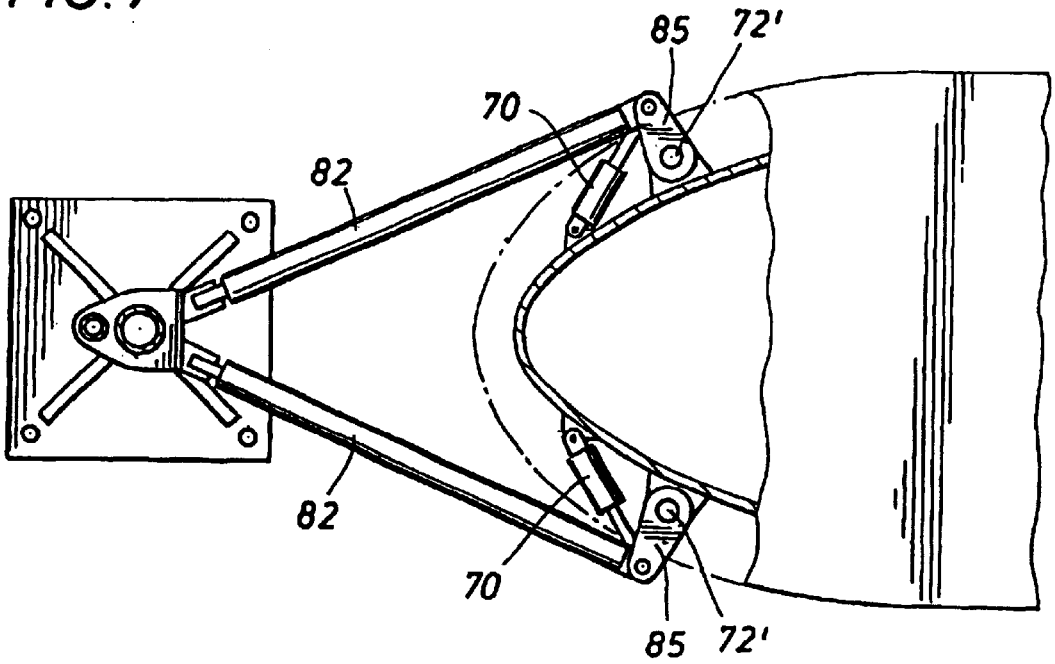
FIGS. 7 and 8 are top and side views of a vertical axis stiff yoke mooring arrangement with dual redundant hydraulic cylinders.
Figure 8:
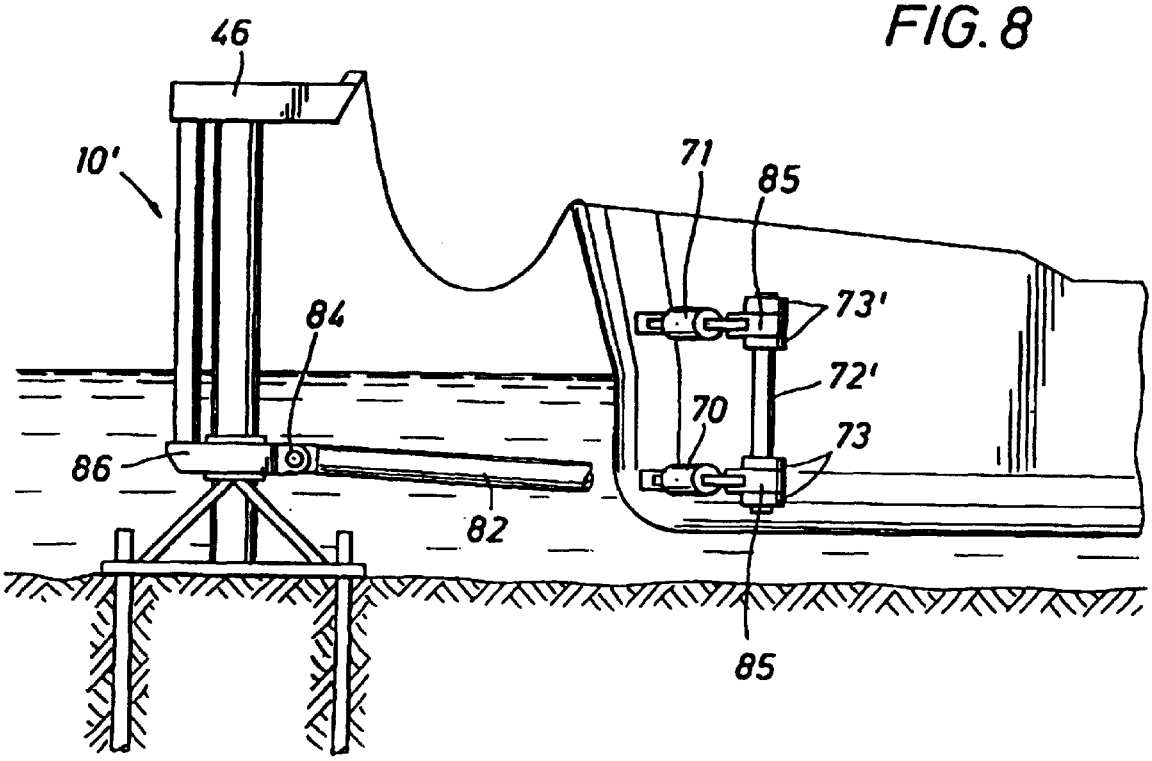

The mooring arrangement of FIGS. 7 and 8 is similar to that of FIGS. 5 and 6, but the shaft 72' is mounted vertically. The hydraulic cylinders 70 can be mounted in plane with the strut 82 and connected torque arm 85 in a single cylinder system 70, e.g., below the water line or a double cylindrical system 70, 71 may be provided where one or both cylinders 70 or 71 are above water line or one is above, the other below or both below. Above water line cylinder systems are easier to maintain than those that are submerged.

The shaft 72 could be internal to the hull with a hull trunk mounted horizontal as described below for alternative 6, or the shaft could protrude through the bottom of the hull similar to that of Embodiment 3 described above, with cylinders and bearings internal as well.

In FIG. 8 the shaft 72' torque arms 85 are journaled by water lubricated bearings 73 and bearings 73' which need not be water lubricated. The tower 10' with gooseneck connection to turntable 86 and fluid swivel may be substantially the same as in FIG. 6.

Alternative 5—Torque Tube Yoke Mooring

Figure 9:
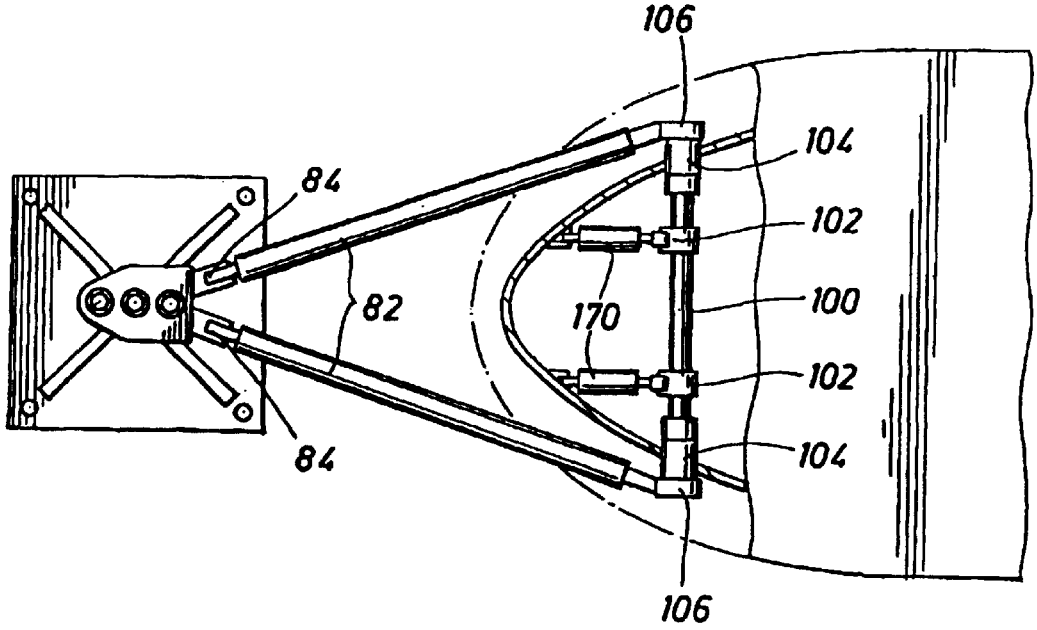
FIGS. 9 and 10 are top and side views of a torque tube yoke mooring system.
Figure 10:
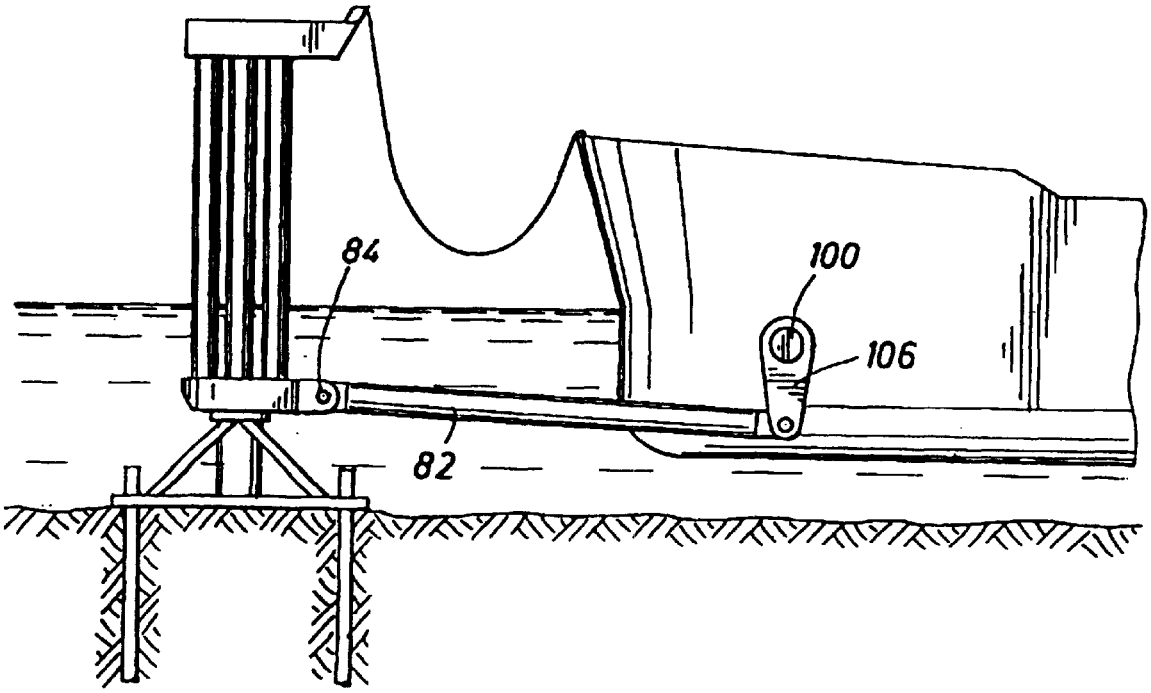

FIGS. 9 and 10 illustrate an embodiment similar to that of FIGS. 5 and 6. With this arrangement there is a single "torque tube" or horizontal shaft 100 which controls both port and starboard external torque arms 106. This provides additional yaw control and provides the advantage of eliminating one if not both inboard bearings. The water lubricated hull penetration bearings 104 are arranged and designed to provide a level of axial restraint, and the torque arms 106 are designed to accept out of plane loading along the axes of struts 82. The shaft and torque arms are of greater section modulus to resist this additional component of bending moment.

The cylinders 170 are redundant in that one hydraulic cylinder achieves active damping as described above by reference to FIGS. 2A, 2B, 2C or the hydraulic cylinder 170 can be an arrangement for passive damping as described above by reference to FIGS. 4 and 4A. In other words, both an active damping arrangement and a passive damping arrangement are simultaneously provided.

A significant advantage of the arrangement of FIGS. 9 and 10, however, is that due to activation through a common torque tube 100, hydraulic cylinder redundancy can be achieved through two rather than four cylinders.

Alternative 6—Stiff Strut Mooring

Figure 11:
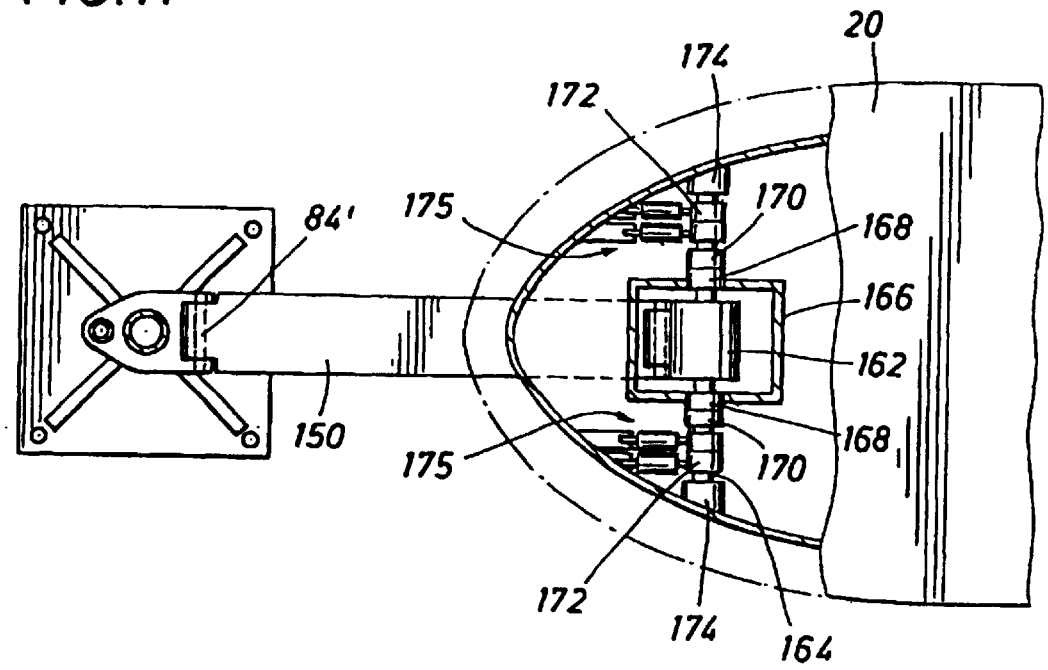
FIGS. 11 and 12 are top and side views of a stiff strut mooring system.
Figure 12:
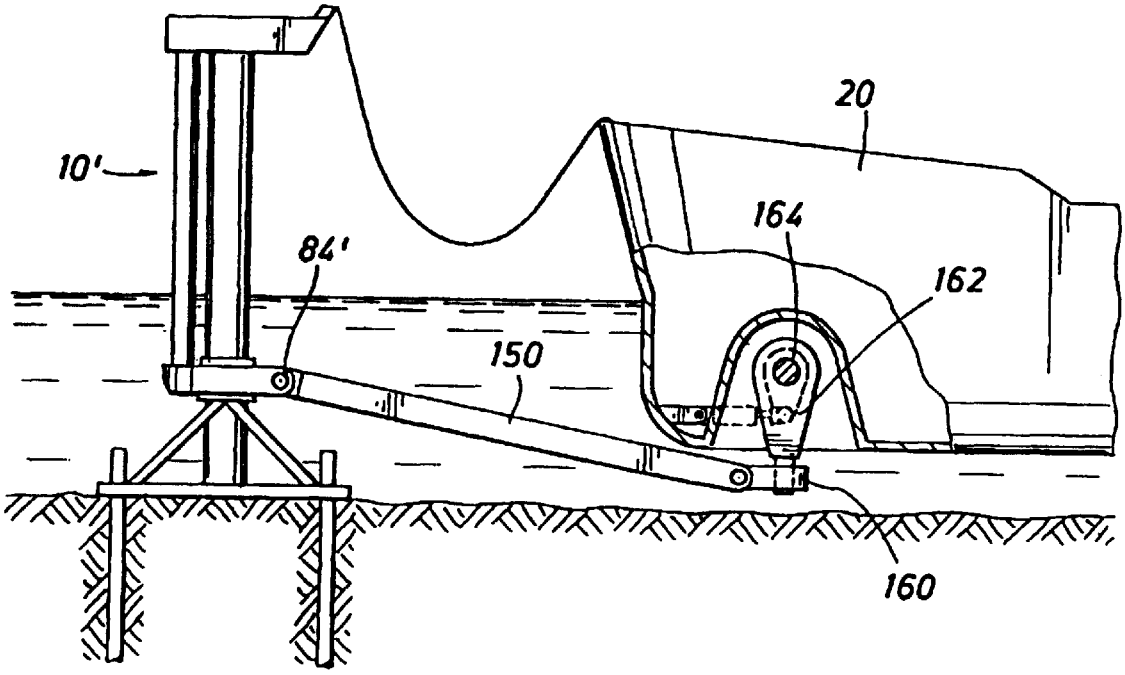

The arrangement of FIGS. 11 and 12 is simplified from the arrangements described above by eliminating the yoke and struts and connecting the vessel 20 to the tower 10' through a single arm 150. Yaw of the vessel is either free or constrained by a torsionally elastic element at the vertical shaft 160 of the hull torque arm 162. The hull torque arm 162 links the vertical shaft 160 to a horizontal shaft 164. The hull torque arm 162 is mounted in a hull trunk 166. The torque arm 162 is connected to shaft 164 which protrudes through the sides of the trunk 166 where water lubricated bearings 168, backed by stuffing glands 170 support the horizontal shaft 164. The shaft 164 includes torque arms 172 and bearings 174 outboard of the torque arms 172. These outboard torque arms 172 are activated by one or two hydraulic cylinders port and starboard which can be either all active, all passive or mixed active and passive.

The cylinders 175, connected between the hull of the vessel 20 and the torque arms 172 are dual redundant hydraulic cylinders 175 with one cylinder on each side being an active damping construction as described above by reference to FIGS. 3A, 3B, 3C, or being a passive spring centered pressure relieved damping device as described above by reference to FIGS. 4 and 4A or mixed. If the shaft 164 is sufficiently strong, redundancy can be reduced by providing one cylinder 175 on the port side and another on the starboard side of the vessel 20 for redundancy. The cylinders can be either passive or active or one passive and the other active.

Figure 13:
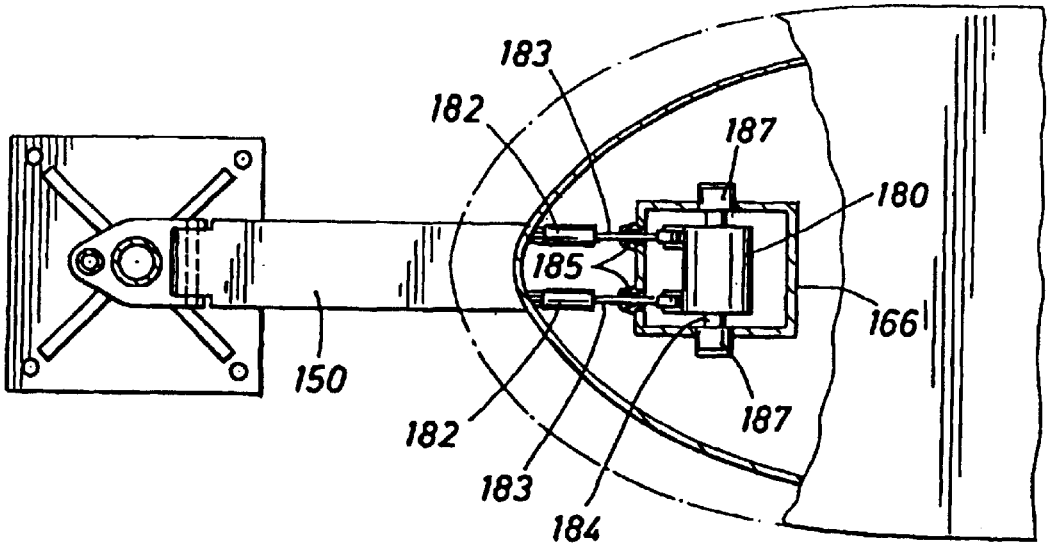
FIG. 13 is a top view of a stiff strut mooring system with hydraulic cylinders acting directly on a central torque arm.

Alternative 7—Stiff Strut Mooring With Hydraulic Cylinders Acting Directly on Central Torque Arm Like the arrangement of FIGS. 11 and 12 of Alternative 6, FIG. 13 shows a horizontal shaft 184 that supports a central torque arm 180 but hydraulic activation is through direct action of cylinder 182 on the torque arm. To facilitate the vertical displacement due to angular rotation and axial displacement of the cylinder rods 183, trunk mounted elastic boots 187 are connected to the rods 183 to prevent seawater leakage. Water lubrication bearings 187 are provided to allow rotation of shaft 184 with respect to trunk 166. The cylinder 182 may provide active forcing or passive damping as described above.

Figure 14:
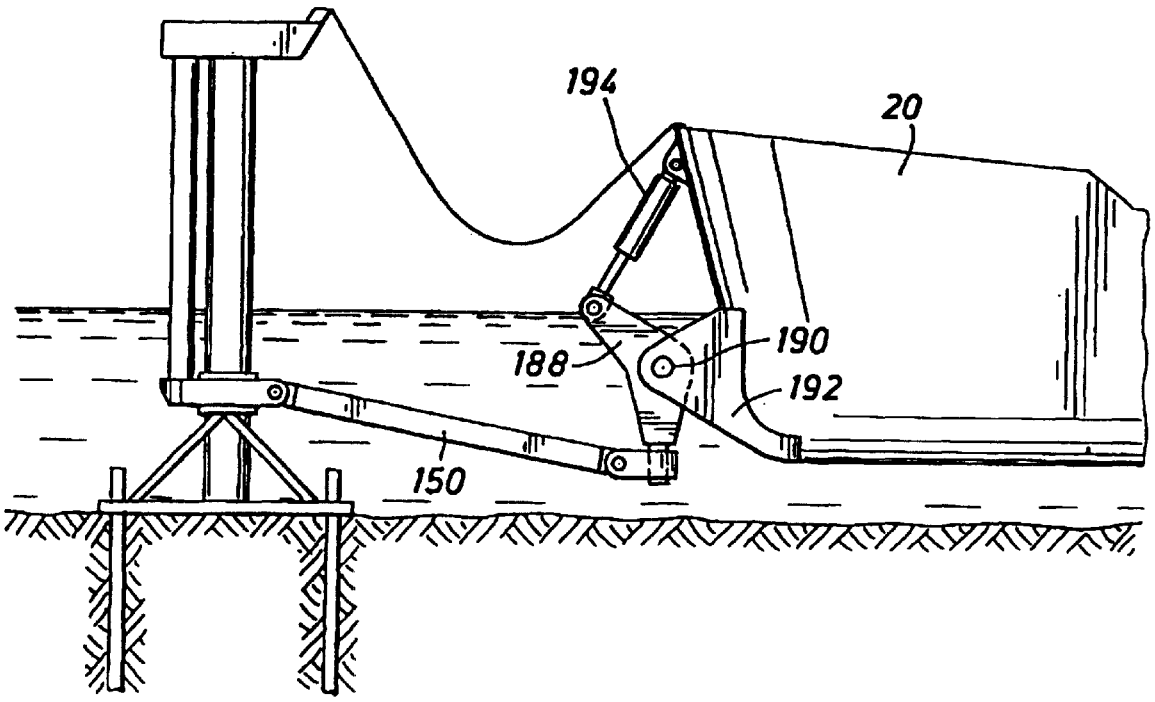
FIG. 14 is a side view of a stiff strut mooring system with hydraulic cylinders acting on a lever arm on the center line of a vessel, but externally mounted.

Alternative 8—Stiff Strut Mooring With Hydraulic Cylinders Acting On Lever On Centerline Of Vessel But Externally Mounted All of the compact configurations described above can be installed in the vessel fore peak space forward of the collision bulkhead. Alternatively, the arrangement of FIG. 14 is externally mounted. The configuration is similar to that of FIG. 13, but the lever or torque arm 188 is supported on a horizontal shaft 190 supported by externally mounted cheek plates 192. At least one, preferably two hydraulic cylinders 194 are pivotably coupled between the torque arm 188 and the vessel 20. As before, the cylinders may be active forcing cylinders as described above, or a passive damping cylinder as described above or mixed. The lever rotation shaft axis is oversized (that is, the shaft 190 has an enlarged diameter), because the strut 150 and cylinders 194 have horizontal components of force which act in the same direction. Nevertheless, the hydraulic cylinders are above water, accessible and maintainable.

Alternative 9—Stiff Strut Mooring With Hydraulic Cylinders Acting On Lever On Centerline Of Vessel But Externally Mounted (Cylinder Reversed)

Figure 15:
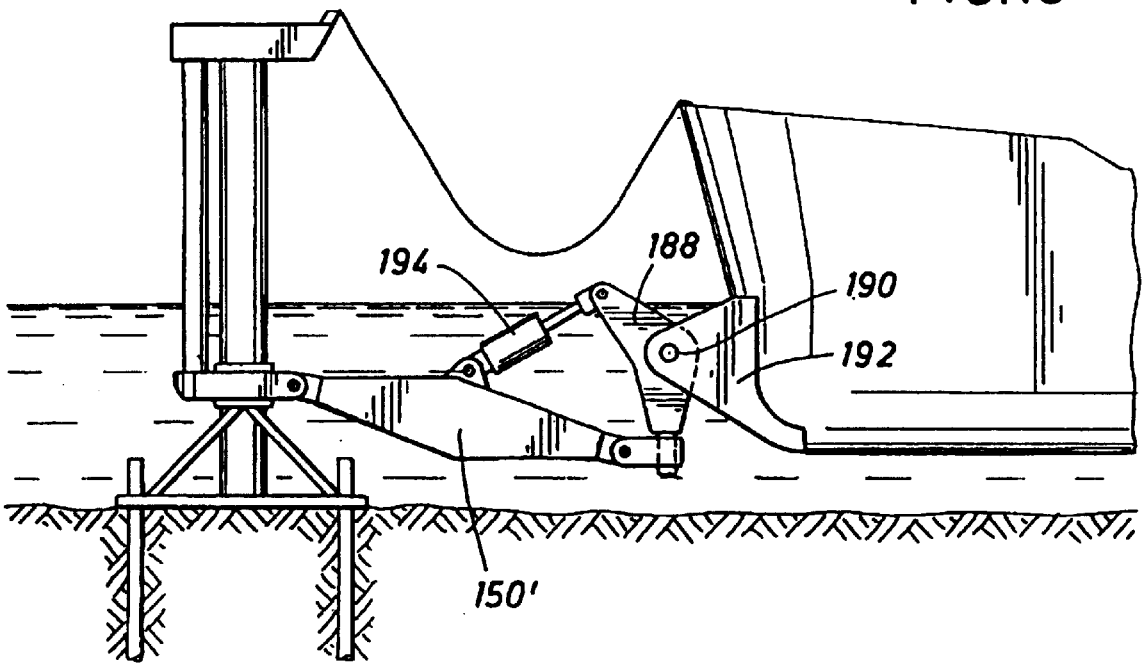
FIG. 15 is a side view of a stiff strut mooring system with one or more hydraulic cylinders acting on a lever arm on the center line of the vessel but with the mounting reversed from that of FIG. 14.

The arrangement of FIG. 15 modifies the arrangement of FIG. 13 by reversing the cylinder 194 and mounts to the strut 150', thereby canceling those horizontal components but requiring cylinders with twice the stroke to allow the same vessel translation.

Alternative 10—Shallow Water Single Point Mooring Disconnectable Tower

Figure 17:
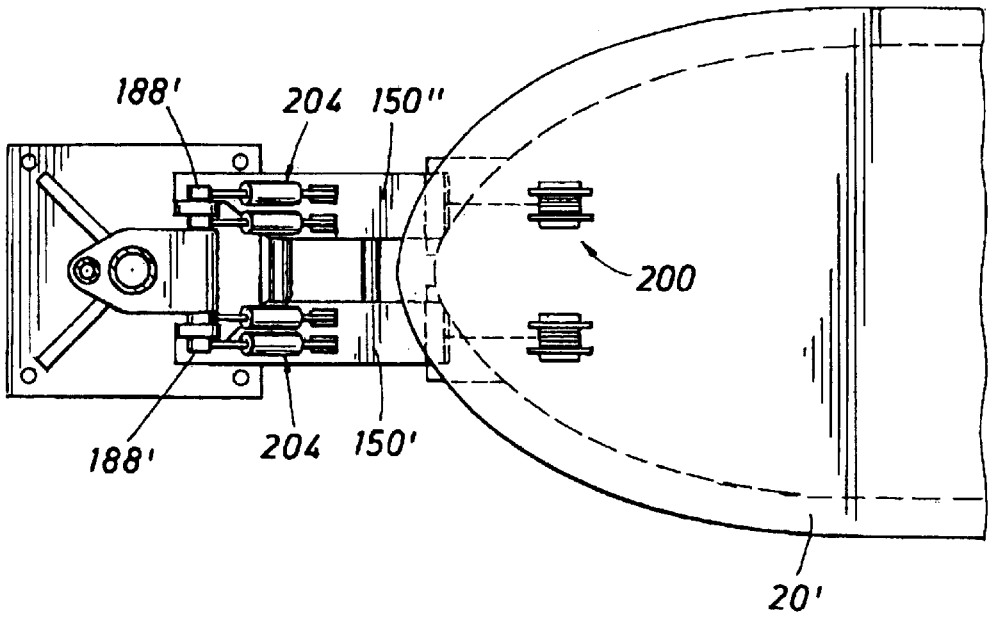
FIGS. 16 and 17 are side and top views of a disconnectable mooring system arranged and designed for shallow water installations where the lever arms of FIGS. 14 and 15 are connected to the tower rather than to the vessel.
Figure 16:
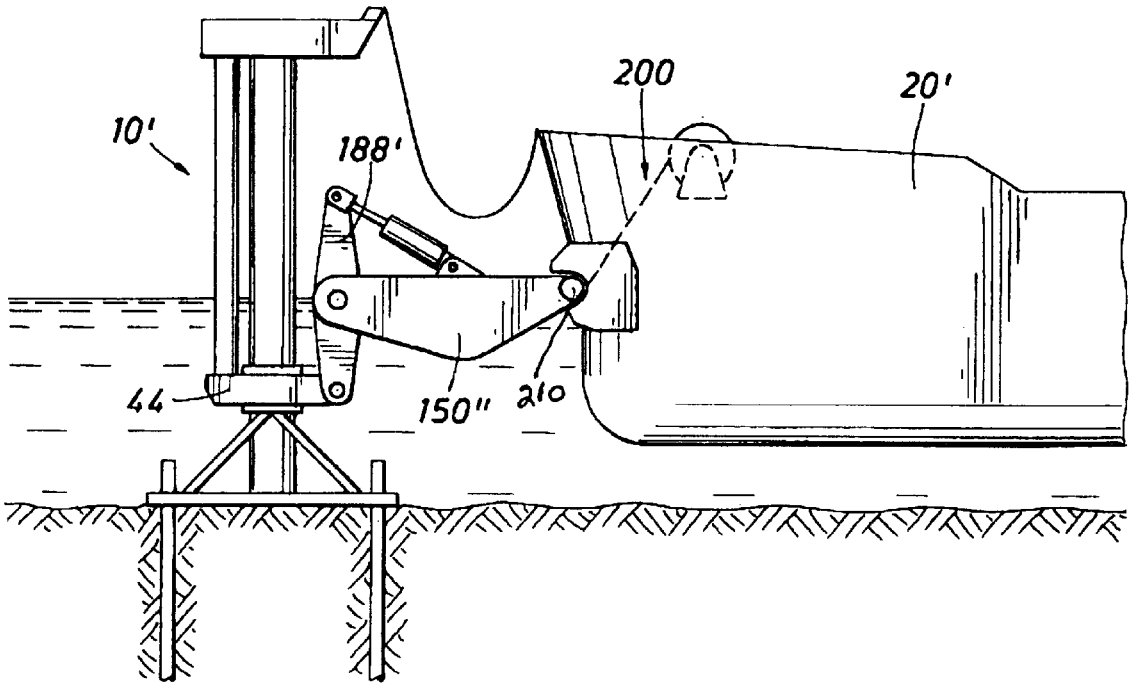

The arrangement of FIGS. 16 and 17 reverses the connection of the lever arm and combines some elements of previous Alternatives to offer a disconnectable single point mooring system for shuttle tankers. By providing a floating strut 150" and the majority of the control equipment at the tower 10', a mooring point is provided which can connect through pull-in couplings 200 to shuttle tankers 20' minimally modified. Because the system of FIGS. 16 and 17 does not rely on pendular weight for restoring forces, the yoke arms or struts 150" can be made light enough to float after disconnection from the vessel, Dual redundancy damping cylinders 204 are coupled between the lever or torque arms 188' and the struts 150". The torque arms 188' are also pivotably coupled to the turntable 44 of the tower 10'.

Figure 18:
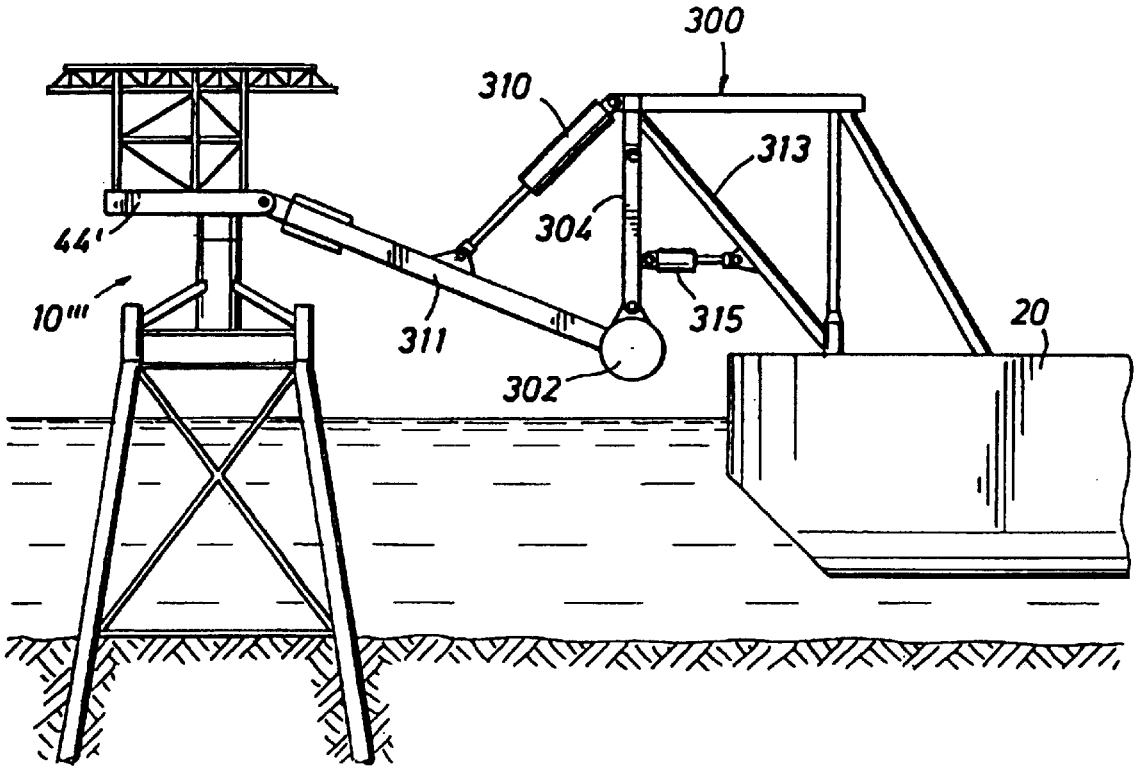
FIG. 18 is a side view of a tower-yoke mooring system with ballast weights of a pendulum system and with active and/or passive damping.

Alternative 11—Tower/Yoke System With Ballast Weights With Active and/or Passive Damping FIG. 18 is a side view of a tower based mooring system with a yoke rotatably supported on a turntable 44 of the tower 10'". A ballast cylinder 302 is placed below tension members 304 which are coupled indirectly to the vessel 20 via a suspension frame 300. A hydraulic cylinder 310 either like that of FIG. 2A (active forcing) or like that of FIG. 4 (passive damping), or both an active cylinder and passive cylinders, is placed between each yoke arm 311 and the frame 300 or alternatively between frame members and each of the tension members 304. The alternative locations of the hydraulic cylinder 310 may include two cylinders 315 placed, for example between a central frame member 313 and side tension members 304 to provide damping to motion in a side direction to the yoke. The location of damping devices, such as hydraulic cylinders can be placed anywhere to damp the motion of the vessel relative to the tower. Both passive damping and active forcing cylinders may be provided for redundancy.

Figure 18A:
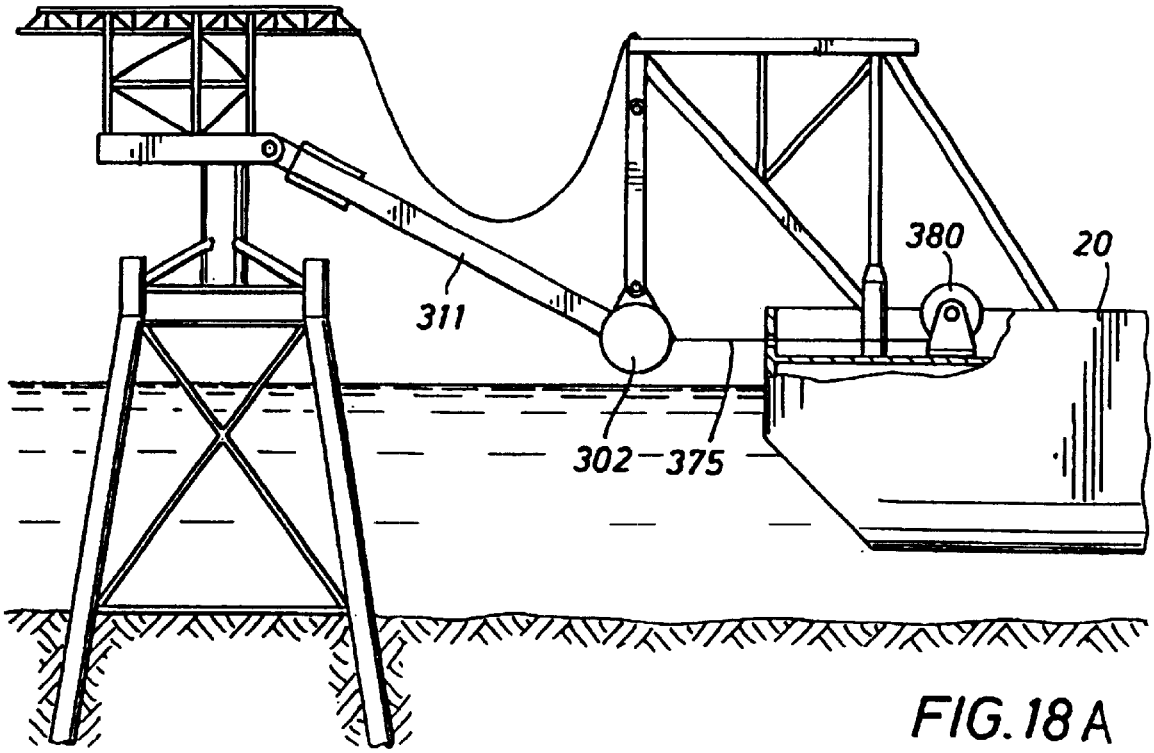
FIG. 18A is a schematic illustration similar to that of FIG. 18 but with a winch/tension element as the mechanism for providing active force restoration.

FIG. 18A shows an alternative arrangement for active forcing control of the mooring systems of FIG. 18. A flexible tension member 375 is secured between the yoke arms 311, for example at ballast members 302, and a powered winch 380. Uni-direction position active control is illustrated in FIG. 18A. Bi-directional control is activated by placing a second winch on the vessel 20 and connecting a cable or wire rope to the ballast member 302 after passing through a turning block connected to the end of a spar to create a force tending to separate the vessel from the tower. The winch 380 or winches are responsive to sensors of a PID controller as illustrated in FIGS. 1 and 2C to produce a control force on the vessel as a function of displacement as illustrated by curve C of FIG. 1.

Figure 19:
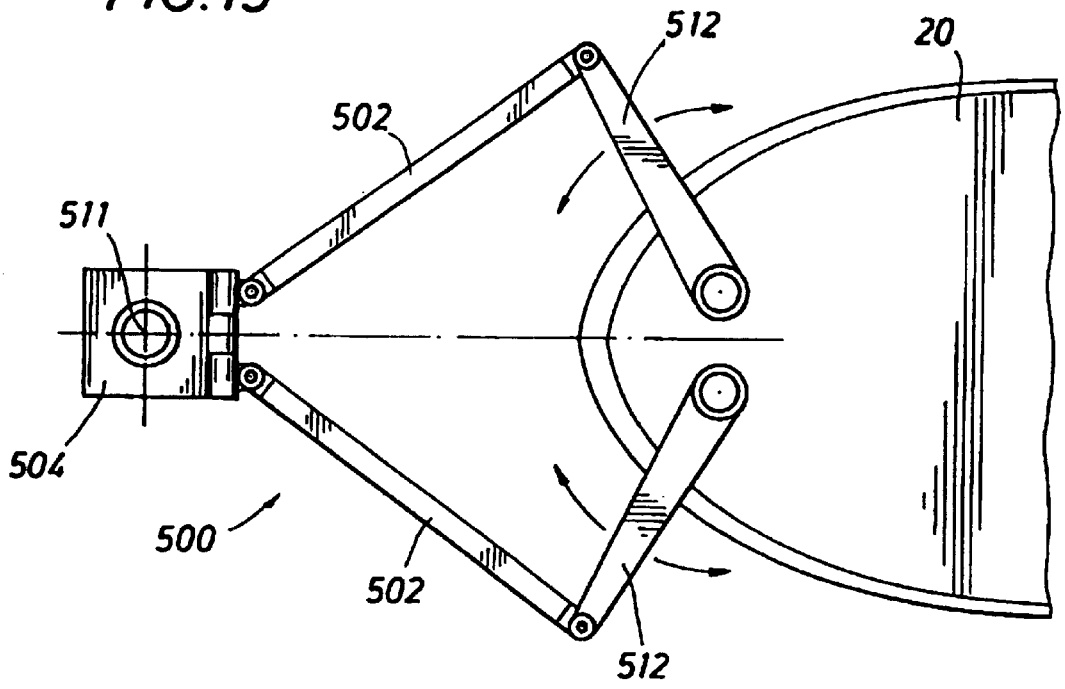
FIGS. 19 and 20 are schematic illustrations of a yoke mooring system with torque arms which include hydraulic torque activators for actively or passively providing restoring force.
Figure 20:
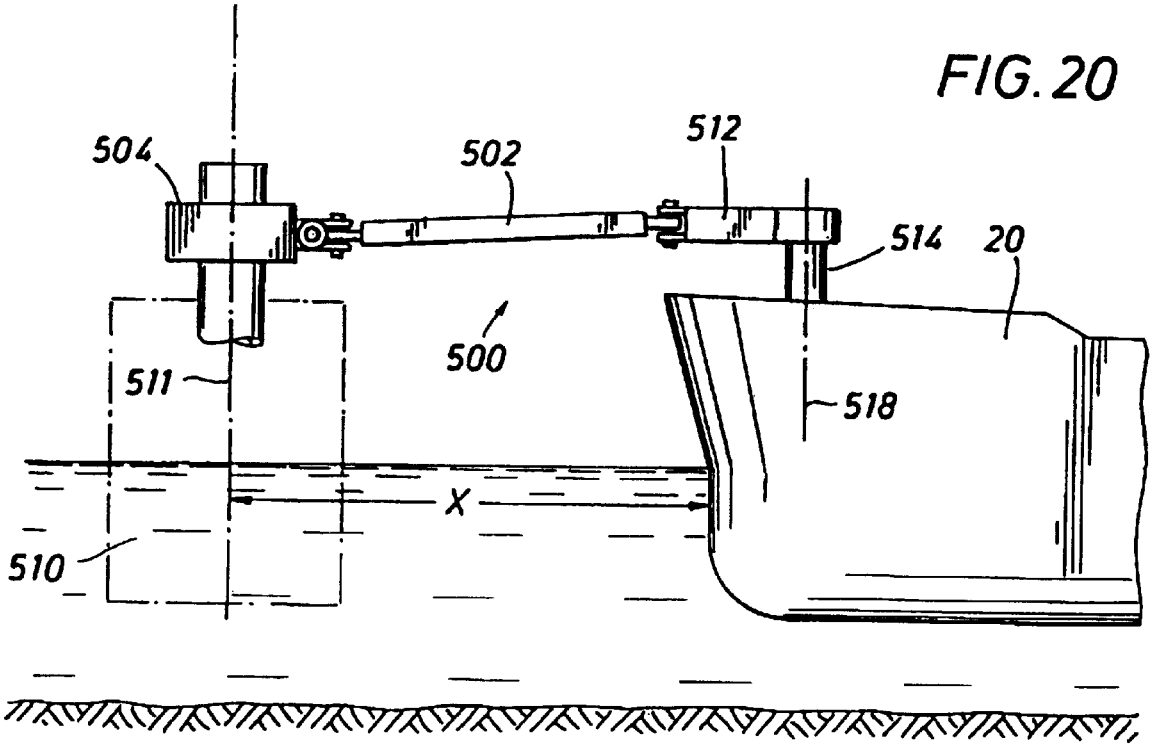

Alternative 12—Torsion Yoke Arm Damping System with Active and/or Passive Damping FIGS. 19 and 20 are top and side views of a mooring system 500 where yoke arms 502 are coupled to a turntable 504 rotatably supported on a central shaft of a tower, pier, spar, SPM FPSO or spread moored FPSO, all schematically represented by the block 510. A hydraulic torque actuator is pivotably coupled to each of the yoke arms 502 and a torsion spring element 514 disposed on the vessel 20. The torsion spring element 514 acts in series with the hydraulic actuator 512 or in parallel with it to reduce the back and forth motion x of the vessel 20 with respect to the central shaft 511.

Figure 21:
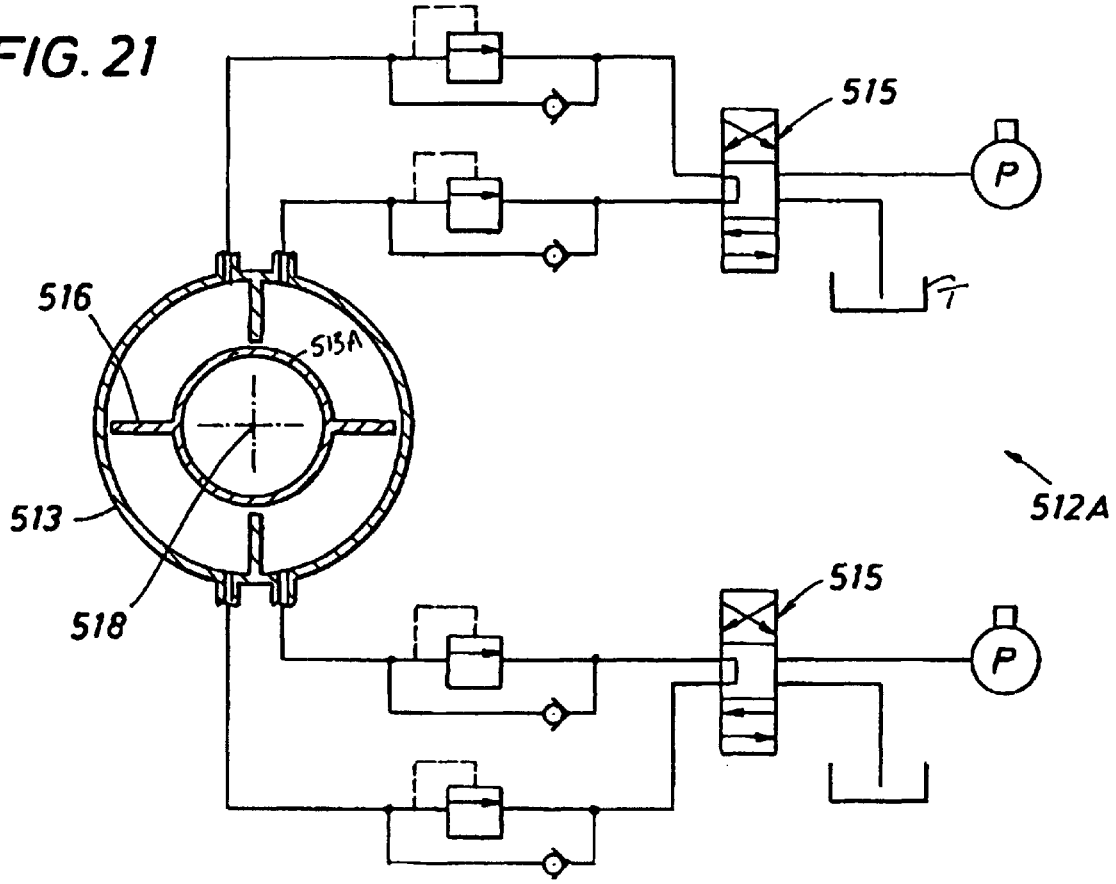
FIGS. 21 and 22 are respectively active and passive hydraulic activators suitable for use with the system of FIGS. 19, 20.

Several examples of hydraulic torque actuators 512 for the arrangement of FIGS. 19 and 20 are presented below. FIG. 21 shows a top view of a hydraulic torque actuator 512A for active control. A cylinder 513 is divided into one or more chambers with internal fins 516 in each of the chambers connected alternatingly to outside cylinder 513 and inside cylinder 513A to form oil tight chambers. Control valve 515, pilot controlled by a PID controller which senses angular deflection about axis 518, causes actuator 512A actively to oppose displacement x of the vessel 20 from its quiescent state, by admitting pressurized oil into alternating chambers to generate torque between cylinder 513A connected to the hull and cylinder 513 connected to torque arm. Alternatively, the PID controller can pressure modulate the pump 515 to achieve displacement opposition.

Figure 22:
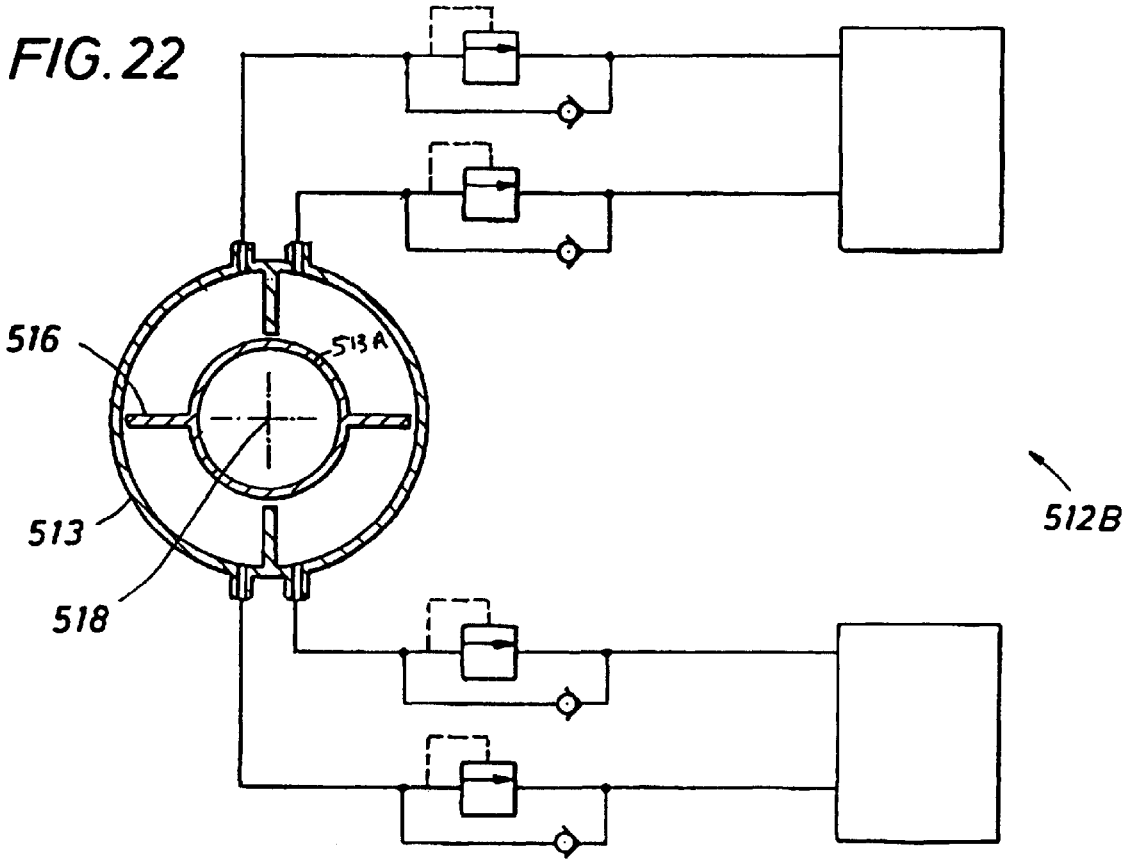

A similar arrangement is illustrated in FIG. 22 where a passive control arrangement provides damping of the angular motion of hydraulic torque actuator 512B about shaft 518 to be used with a restoring force device such as torsion springs and/or pendular weights. In this arrangement, when vessel displacement results in angular rotation of cylinder 513A relative to cylinder 513, oil in the chambers formed by fins 516 as above results in volume changes in the oil tight chambers. Decreasing volume is expelled through relief valves A or A' while oil to increasing volume is sucked from reservoir T. Expelling oil from decreasing volume chambers through check valves creates resisting pressure and torque which resists angular motion.

Figure 23:
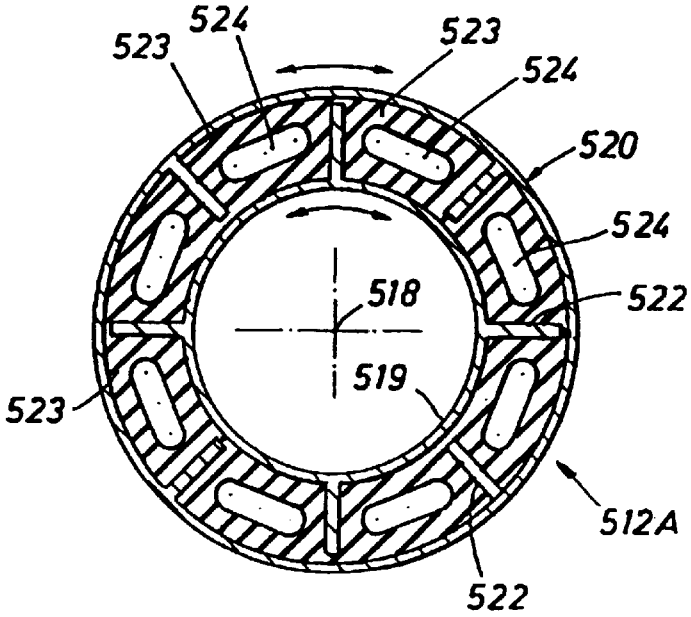
FIG. 23 illustrates an elastomeric damping mechanism which can be used in place of the torque activators of FIGS. 19 and 20 to provide both spring restoring and damping resistance to angular motion.

As an example of a torsion damping element, a spring element 512A is illustrated also below. FIG. 23 illustrates a cylindrical module having inner and outer annular walls 519, 520 and internal fins 522 which separate the annular space between walls 519, 520 into a segment filled with elastomeric material 523. Thus fins 522 are alternatingly connected to walls 519 or 520. Inner wall 519 is arranged and designed to be coupled to vessel 20; outer wall 520 is designed and arranged to be coupled to arm or actuator 512. Voids 524 in each segment 523 allow the elastomeric material to compress between corresponding alternating connected fins 522 as the outer wall 520 tends to rotate about the inner wall 519.

Another example of a torsion damping element 530 is illustrated in FIGS. 24 and 25 in a top cross section view to be used with a restoring force device such as torsion springs and/or pendular weights. The torsion damping element 530 of FIGS. 24, 25 includes inner and outer cylindrical walls 532, 534 which are arranged and designed to accept brake disks 535 as shown in FIG. 25. When hydraulic pressure is applied to brake pressure ring 536, the disks, which are alternatingly connected to walls 534 are forced into sliding contact with one another resulting in friction which retards relative motion between the outer wall 534 and inner wall 532.

Alternative 13—Position Control with Anticipation

Figure 26:
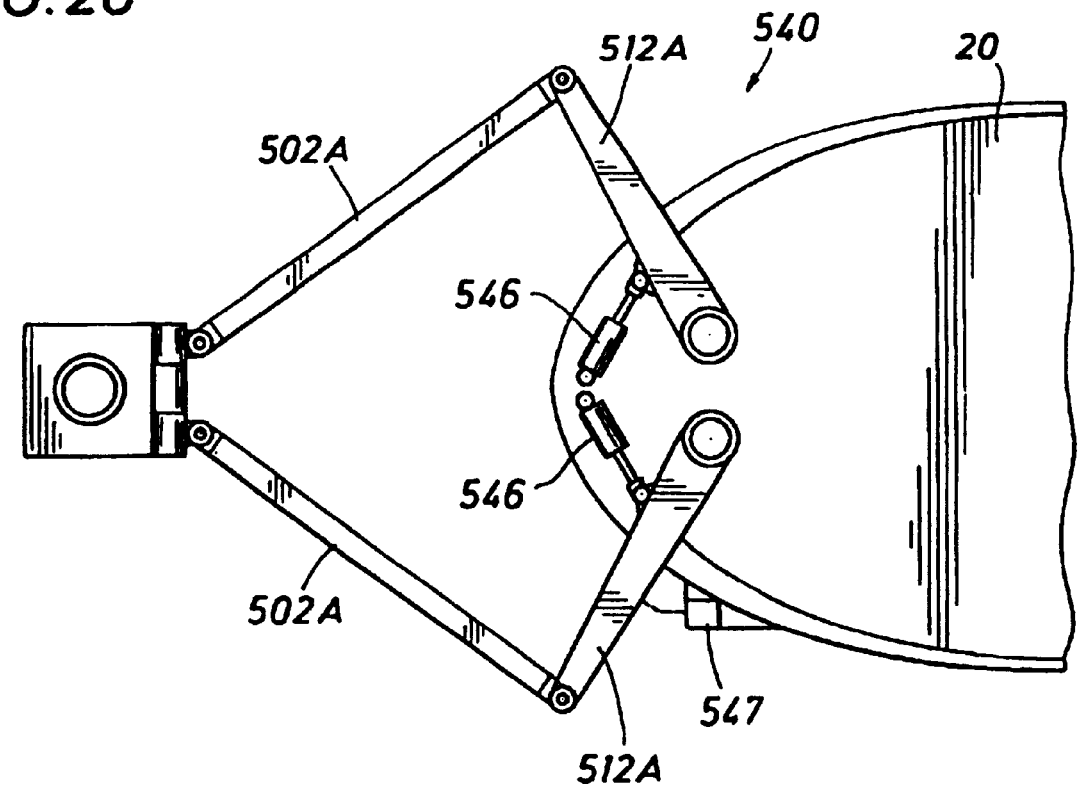
FIGS. 26 and 27 illustrate schematically hydraulic cylinders for active or passive damping torsion arms of a tower-yoke-vessel mooring system.
Figure 27:
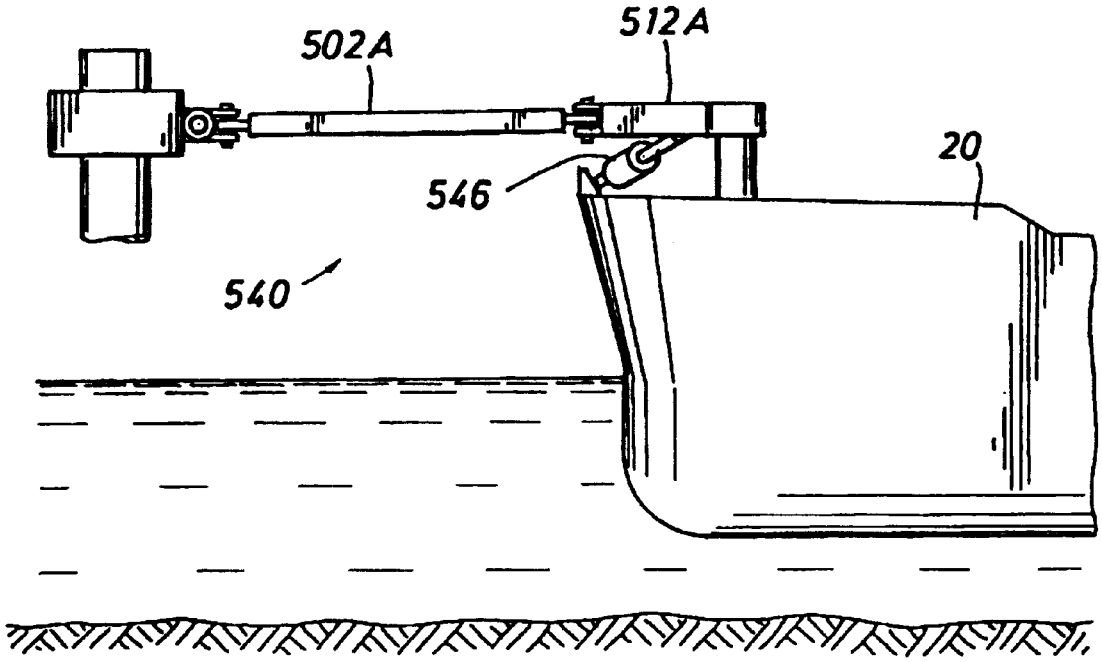

FIGS. 26 and 27 schematically illustrate in top and side views a mooring arrangement similar to that of FIGS. 19 and 20, but with hydraulic cylinders 546 positioned between the vessel 20 and torque arms 512A. A sensor 547 is provided for measurement of the angle of the torque arms from the quiescent position of the vessel. The hydraulic cylinders are provided with PID controls and circuitry to actively force or passively dampen the motion of the vessel 20. Predictive circuits responsive to sea condition sensors are provided to predict the force of wind, waves, and current on the vessel 20 to actively apply forces, via the cylinder 546, to oppose such forces.

Figure 28:
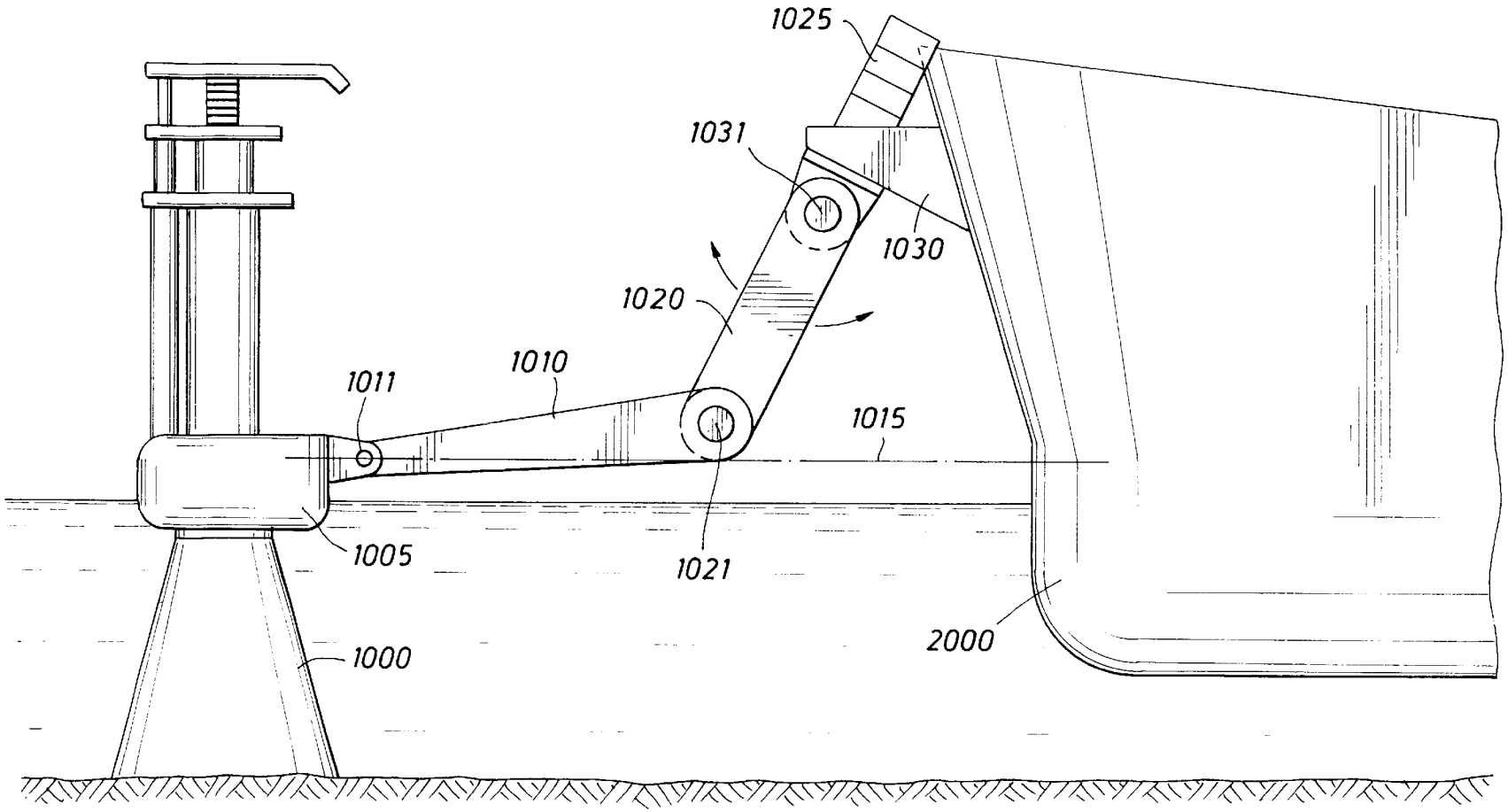
FIG. 28 illustrates schematically an arrangement with an arm which couples a vessel to a tower where the turntable is located along a line which runs through an average roll axis of the vessel and where the arrangement includes a passive damping element.

Alternative 14—Tower Yoke System with Yoke Coupled to Tower at a Position In-Line with Roll Axis of Vessel FIG. 28 illustrates an alternative embodiment of the invention with a tower 1000 having a turntable 1005 rotatably supported on the tower by water lubricated bearings for example. A first arm 1010 is pivotably connected at 1011 to turntable 1005 at a height which is located at or about the average projection 1015 of the vessel longitudinal roll axis at its intersection with the vertical axis of the tower. A second arm 1020 is pivotably connected to the first arm 1010 at pivot 1021. A torsion spring mechanism can be provided at coupling 1021 as appropriate. A spring damper mechanism 1025 e.g., like one of the torsion spring mechanisms described above, is supported by a vessel bracket 1030 and is rotatably coupled with two degrees of rotation to second arm 1020 at pivot 1031.

The arrangement of FIG. 28 effectively removes the roll component of the vessel 2000 on the mooring arms 1010, 1020 because of the placement of the connection 1011 of the arm 1010 to turntable 1005 along the average projection of the vessel longitudinal axis 1015 at the tower 1000. The arrangement of FIG. 28 produces a similar restoring force as that of FIG. 18, without using a pendular weight as restoring element. The damping mechanism 1025 may be advantageous in resisting yaw forces.

Other Damping Components

Active and passive damping components are described for vessel mooring systems and disposed in various configurations for tower-arm/yoke-vessel systems. Such damping components may also be useful in certain CALM systems which have high momentum energy and could benefit, like the arrangements discussed above, from active forcing systems or passive damping systems which exert restoring forces which are independent of vessel position.

Other damping components such as brake shoes on linearly sliding structures (damping force only), brake shoes on rotating disks or drums (damping force only), cables on winches or drums (restoring force and/or damping force) and elastomeric elements with restoring force and/or damping force can be substituted for hydraulic cylinder components.

The drawings presented above for various coupling arrangements between a body (such as a tower) and a vessel are schematic in nature. One of skill in the art of offshore mooring systems will understand that two or three axes may be provided as required at the various pivoting joints.

What is claimed is:

1. In a mooring system for maintaining a vessel at the surface of a body of water in a position in relation to a body which is secured to the bottom of the body of the water, where the mooring system includes at least one arm coupled at a first end of the arm to the body, said arm having a second end coupled by connecting means to said vessel, said vessel experiencing oscillation of a certain magnitude in displacement about a quiescent position in response to environmental conditions of said body of water, an improvement comprising, means for generating a displacement signal representative of displacement of said vessel from said quiescent position, and means responsive to said displacement signal for applying a force to said arm in a direction to move said vessel toward said quiescent position, whereby said magnitude of said oscillations of said vessel and peak mooring loads are reduced.

2. The mooring system of claim 1 wherein said body is a bottom founded tower.

3. The mooring system of claim 1 wherein said body is a mooring buoy.

4. The mooring system of claim 2 wherein said arm is coupled to said bottom founded tower at a submerged location.

5. The mooring system of claim 2 wherein said arm is coupled to said bottom founded tower at an above sea-surface position.

6. The mooring system of claim 1 further comprising a passive damping means coupled between said arms and said vessel for damping said magnitude of oscillation of said vessel about said quiescent position, said passive damping means being in addition to the damping effect of water acting against the vessel or the arm.

7. The mooring system of claim 1 further comprising passive damping means coupled between said arm and said body for damping the oscillation of said vessel about said quiescent position, said passive damping means being in addition to the damping effect of water acting against the vessel or the arm.

8. The mooring system of claim 1 wherein said means responsive to said displacement signal for applying said force to said arm includes a PID controller.

9. The mooring system of claim 1 wherein said connecting means includes a rocker arm (12) having top, middle and bottom portions with said middle portion pivotably coupled to said vessel, said bottom portion pivotably coupled to said second end of said arm and an actuating device (28) pivotably coupled to said top portion (17) of said rocker arm and to said vessel and which is automatically forced to pull or push the top portion (17) of said rocker arms (12) in a direction to oppose the direction of motion of said vessel.

10. The mooring system of claim 9 wherein said actuating device includes an angular position sensing device (22) disposed at said top portion (17) of said rocker arm (12) for producing an angular signal representative of angular position of said rocker arm.

a hydraulic cylinder (30) and piston arm (32) coupled between said top portion (17) of said rocker arm (12) and said vessel (20), and a PID controller (24) responsive to said angular signal and to a signal representative of a quiescent position of said rocker arm for applying pressurized hydraulic fluid to one of opposite ends of said cylinder (30) to force said arm (32) in a direction to force said rocker arm toward a quiescent position thereby to oppose the direction of motion of said vessel.

11. The mooring system of claim 6 wherein said passive damping means includes a damping cylinder (47) coupled between said second end of said arm (14) and said vessel.

12. The mooring system of claim 11 further comprising a buoyant strut (48) coupled between said hydraulic cylinder (47) and said vessel.

13. The mooring system of claim 12 wherein said damping cylinder (47) includes a damping mechanism and a spring to provide a direct spring restoring force and damping force to reduce vessel motion and mooring loads due to environmental forces.

14. The mooring system of claim 12 wherein said body is a bottom founded tower having a submerged turntable (44) disposed thereon, and said first end of said arm (14) is pivotably connected to said turntable.

15. The mooring system of claim 14 wherein said tower includes a top portion which extends above the sea surface, and further including a product swivel (60) mounted on said above-water top portion of said tower, and a hydrocarbon fluid conductor (62) running directly from said swivel (60) to said vessel (20) without being supported by a ship super structure or said arms.

16. The mooring system of claim 1 wherein said connecting means includes a shaft (72) rotatably supported on said vessel (20), and a first torque arm (78) secured to said shaft (72) and to said second end of said arm (82), and said means responsive to said displacement signal includes a hydraulic cylinder coupled between said vessel (20) and a second torque arm (78) secured to said shaft (72).

17. The mooring system of claim 16 further including passive damping means coupled between said vessel (20) and said torque arm (78).

18. The mooring system of claim 16 wherein said shaft (72) is disposed generally horizontally.

19. The mooring system of claim 16 wherein said shaft (72) is disposed generally vertically.

20. The mooring system of claim 1 wherein two arms are coupled between said body and said vessel, with each of said two arms having a first end coupled to said body, each of said two arms having a second end coupled by connecting means to opposite sides of said vessel, each of said connecting means including a shaft (72) rotatably supported on said vessel and a torque arm (78) secured to said shaft (72) and to a respective second end of said first or second arm (82), said means responsive to said displacement signal including first and second hydraulic cylinders coupled between said vessel (20) and said respective shaft torque arm (78).

21. The mooring system of claim 20 further comprising first and second passive damping means coupled between said vessel (20) and said respective torque arm (78).

22. The mooring system of claim 1 wherein two arms are coupled between said body and said vessel, with each of said two arms having a first end coupled to said body, each of said two arms having a second end coupled by connecting means to opposite sides of said vessel, said vessel having a single horizontal shaft (100) rotatably supported on said vessel, each said connecting means including a torque arm (102) secured to said shaft and to a respective second end of said first or second arm (82), said means responsive to said displacement signal including first and second hydraulic cylinders coupled between said vessel (20) and said respective shaft torque arm (102).

23. The mooring system of claim 1 wherein two arms are coupled between said body and said vessel, with each of said two arms having a first end coupled to said body, each of said two arms having a second end coupled by connecting means to opposite sides of said vessel, said vessel having a single horizontal shaft (100) rotatably supported on said vessel, each said connecting means including a torque arm (102) secured to said shaft and to a respective second end of said first or second arm (82), said means responsive to said displacement signal including a first hydraulic cylinder (170) coupled between said vessel (20) and a first torque arm (102), and further comprising a passive damping means coupled between said vessel (20) and a second torque arm (102).

24. The mooring system of claim 1 wherein said at least one arm is a single arm coupled between said body and said vessel, said vessel having a horizontal shaft (164) rotatably supported on said vessel, said second end of said single arm being coupled to said shaft (164) by a hull torque arm, first and second torque arms (172) mounted on said horizontal shaft, said means responsive to said displacement signal including a first hydraulic cylinder coupled between said vessel (20) and a first torque arm (172), and further comprising a passive damping means coupled between said vessel (20) and said second torque arm (172).

25. The mooring system of claim 1 wherein said at least one arm (150) is a single arm coupled between said body and said vessel, said vessel having a horizontal shaft (164) rotatably supported on said vessel, said connecting means including a torque arm (180) secured to said horizontal shaft (184), and said means responsive to said displacement signal including a hydraulic cylinder (182) coupled between said second end of said arm (150) and said torque arm (180).

26. The mooring system of claim 25 further comprising a passive damping means coupled between said second end of said arm (150) and said torque arm.

27. The mooring system of claim 25 wherein said horizontal shaft extends through an interior portion of said vessel.

28. The mooring system of claim 1 wherein said at least one arm (150) is coupled between said body and said vessel, said vessel having an externally mounted horizontal shaft (190) rotatably supported on said vessel, said connecting means including a torque arm (188) secured to said horizontal shaft (190), said means responsive to said displacement signal including a first hydraulic cylinder coupled between said vessel (20) and said torque arm (188).

29. The mooring system of claim 28 further comprising, a passive damping means coupled between said torque arm (188) and said vessel (20).

30. The mooring system of claim 1 wherein said at least one arm (150') is coupled between said body and said vessel, said vessel having an externally mounted horizontal shaft (190) rotatably supported on said vessel, said connecting means including a torque arm (188) having lower, middle and top portions, said middle portion being secured to said horizontal shaft (190), said lower portion being secured to said second end of said arm (150'), said means responsive to said displacement signal including a first hydraulic cylinder coupled between said top portion of said torque arm (188) and said arm (150').

31. The mooring system of claim 30 further comprising, a passive damping means coupled between said top portion of said torque arm (188) and said arm (150').

32. The mooring system of claim 1 wherein said at least one arm (150") is coupled between said body and said vessel (20'), said arm (150") being buoyant and connected to said vessel by a pull-in coupling, said body including a turntable (44) having a horizontal shaft rotatably supported thereon, said connecting means including a torque arm (188') having lower, middle and top portions, said lower portion being rotatably supported on said horizontal shaft, said middle portion of said torque arm (188') rotatably supporting said first end of said arm (150"), said means responsive to said displacement signal including a first hydraulic cylinder coupled between said top portion of said torque arm (188') and said arm (150").

33. The mooring system of claim 32 further comprising, a passive damping means coupled between said top portion of said torque arm (188') and said arm (150").

34. The mooring system of claim 1 wherein said connecting means includes a torsion spring element (514) mounted on said vessel, and an active torque actuator (512) arrangement is coupled to said torsion spring element (514) and pivotably coupled to said second end of said arm.

35. The mooring system of claim 34 wherein said torque actuator (512) is an active control hydraulic torque actuator means.

36. Mooring apparatus for mooring a vessel in a body of water comprising a mooring body substantially fixed to the floor of the body of water, an arm rotatably coupled at one end to said mooring body and coupled at its second end to said vessel by a coupling arrangement, means for generating a signal representative of displacement away from a quiescent position of said vessel, and means responsive to said signal for applying a force to said arm in a direction to cause said vessel to return to said quiescent position.

37. The apparatus of claim 36 wherein said force applied to said arm is substantially constant.

38. In a mooring system for maintaining a vessel at the surface of a body of water in a position in relation to a body which is secured to the bottom of the body of water, where the mooring system includes at least one arm coupled at a first end of the arm to the body, said arm having a second end coupled to a frame secured to said vessel, said arm having a pendular weight coupled to said frame, said vessel moving closer to and away from said body about a neutral position in response to environmental conditions of said body of water, said pendular weight providing increasing force to said arm in a direction to move said vessel toward said neutral position as a function of increasing distance that said vessel has moved from said neutral position, an improvement comprising a damping element (310) coupled between said frame and said arm, said damping element being in addition to the damping effect of water acting against the vessel or the arm.

39. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environment conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and means for generating a displacement signal representative of displacement of said vessel from said quiescent position, and means responsive to said displacement signal for applying a substantially constant force to said arm in a direction to move said vessel toward said quiescent position, whereby magnitude of said oscillations of said vessel are reduced.

40. The mooring system of claim 39 wherein said passive damping means is coupled between said arm and said vessel.

41. The mooring system of claim 39 wherein said passive damping means is coupled between said arm and said body.

42. The mooring system of claim 39 wherein said body is a bottom founded tower.

43. The mooring system of claim 39 wherein said body is a mooring buoy.

44. The mooring system of claim 42 wherein said arm is coupled to said bottom founded tower at a submerged location.

45. The mooring system of claim 42 wherein said arm is coupled to said bottom founded tower at an above sea surface position.

46. The mooring system of claim 39 wherein said means responsive to said displacement signal for applying a substantially constant force to said arm includes a PID controller.

47. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said connecting means includes a rocker arm (12) having top, middle and bottom portions with said middle portion pivotably coupled to said vessel, said bottom portion pivotably coupled to said second end of said arm and said passive damping device is a hydraulic cylinder pivotably coupled to said top portion of said rocker arm and to said vessel.

48. The mooring system of claim 47 further comprising an actuating device (28) pivotably coupled to said top portion of said rocker arm and to said vessel and which is arranged and designed to automatically force the top portion (13) of said rocker arm (12) in a direction to oppose the direction of motion of said vessel.

49. The mooring system of claim 48 wherein an angular position sensing device (22) dispersed at said top portion (17) of said rocker arm (12) for producing an angular signal representative of angular position of said rocker arm, a hydraulic cylinder (30) and piston arm (32) coupled between said top portion (17) of said rocker arm (12) and said vessel (20), and a PID controller (24) responsive to said angular signal and to a signal representative of a quiescent position of said rocker arm for applying pressurized hydraulic fluid to one of opposite ends of said cylinder (30) to force said arm (32) in a direction to force said rocker arm toward a quiescent position thereby opposing the direction of motion of said vessel.

50. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, said passive damping means includes a hydraulic cylinder (47) coupled between said second end of said arm (14) and said vessel, and a buoyant strut (48) is coupled between said hydraulic cylinder (47) and said vessel.

51. The mooring system of claim 50 in which said body is a bottom founded tower having a submerged turntable (14) disposed thereon, and said first end of said arm (14) is pivotably connected to said turntable.

52. The mooring system of claim 51 in which said tower includes a top portion which extends above the sea surface, and further including a product swivel (60) mounted on said top portion of said tower, and a hydrocarbon fluid conductor (62) running directly from said swivel (60) to said vessel (20) without being supported by a ship super structure or said arm.

53. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, said passive damping means includes a hydraulic cylinder (47) coupled between said second end of said arm (14) and said vessel, and said damping cylinder (47) includes a damping mechanism and a coiled spring to provide a direct spring restoring force and damping to reduce vessel motion due to environmental forces.

54. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environment conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said connecting means including a shaft (72) rotatably supported on said vessel (20) and first and second torque arms (78, 75) secured to said shaft (72), said second end of said arm (82) secured to said first torque arm (75) and said passive damping means is coupled between said vessel (20) and said second torque arm (78).

55. The mooring system of claim 54 further including means for generating a displacement signal representative of displacement of said vessel from said quiescent position, and means responsive to said displacement signal is coupled between said vessel (20) and said torque arm (78) for applying a force to said arm in a direction to move said vessel toward said quiescent position, whereby magnitude of said oscillations of said vessel are reduced.

56. The mooring system of claim 54 wherein said shaft is disposed generally horizontally.

57. The mooring system of claim 54 wherein said shaft is disposed generally vertically.

58. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein two arms are coupled between said body and said vessel, with each of said two arms having a first end coupled to said body, each of said two arms having a second end coupled by connecting means to opposite sides of said vessel, each of said connecting means including a shaft (72) rotatably supported on said vessel and a torque arm (78) secured to said shaft (72) and to a respective second end of said first or second arm (82), and said passive damping means including first and second hydraulic cylinders coupled between said vessel and said respective shaft torque arm.

59. The mooring system of claim 58 further comprising means for generating a displacement signal representative of displacement of said vessel from said quiescent position, and means responsive to said displacement signal for applying a force to said arm is coupled between said vessel and said respective torque arm to move said vessel in a direction toward said quiescent position, whereby magnitude of said oscillations of said vessel are reduced.

60. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein two arms are coupled between said body and said vessel, with each of said two arms having a first end coupled to said body, each of said two arms having a second end coupled by said connecting means to opposite sides of said vessel, said vessel having a single horizontal shaft (100) rotatably supported on said vessel, said connecting means including first and second torque arms (102) secured to said shaft and to a respective second end of said first or second arm (82).

61. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein, two arms are coupled between said body and said vessel, with each of said two arms having a first end coupled to said body, each of said two arms having a second end coupled by connecting means to opposite sides of said vessel, said vessel having a single horizontal shaft (100) rotatably supported on said vessel, said connecting means including first and second torque arms (102) secured to said shaft and to a respective second end of said first or second arm (82), said passive damping means including a first cylinder coupled between said vessel (20) and a first torque arm (102), and further comprising, an active system means including a hydraulic cylinder coupled between said vessel (20) and a second torque arm (102) for applying a force to cause said vessel to return to said quiescent position.

62. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said at least one arm is a single arm (150) coupled between said body and said vessel, said vessel having a horizontal shaft (164) rotatably supported on said vessel, said second end of said single arm (150) being coupled to said shaft (164) by a hull torque arm (162), first and second torque arms (172) mounted on said horizontal shaft, said passive damping means including a first hydraulic cylinder coupled between said vessel (20) and a first torque arm (172) and further comprising an active forcing means coupled between said vessel (20) and said second torque arm (172) and including a second hydraulic cylinder.

63. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said at least one arm (150) is a single arm coupled between said body and said vessel, said vessel having a horizontal shaft (184) rotatably supported on said vessel, said connecting means including a torque arm (180) secured to said horizontal shaft (184), and said passive damping means including a hydraulic cylinder (182) coupled between said second end of said arm (150) and said torque arm (180).

64. The mooring system of claim 63 further comprising an active forcing system coupled between said second end of said arm (150) and said torque arm.

65. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and in which said at least one arm (150) is coupled between said body and said vessel, said vessel having an externally mounted horizontal shaft (190) rotatably supported on said vessel, said connecting means including a torque arm (188) secured to said horizontal shaft (190), said passive damping means including a first hydraulic cylinder coupler between said vessel (20) and said torque arm (188).

66. The mooring system of claim 65 further comprising, an active forcing system coupled between said torque arm (188) and said vessel (20).

67. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said at least one arm (150') is coupled between said body and said vessel, said vessel having an externally mounted horizontal shaft (190) rotatably supported on said vessel, said connecting means including a torque arm (188) having lower, middle and top portions, said middle portion being secured to said horizontal shaft (190), said lower portion being secured to said second end of said arm (150'), and said passive damping means is coupled between said top portion of said torque arm (188) and said arm (150').

68. The mooring system of claim 67 further comprising, an active forcing system coupled between said top portion of said torque arm (188) and said arm (150').

69. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environment conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and in which said at least one arm (150") is coupled between said body and said vessel (20'), said arm (150") being buoyant and connected to said vessel by a pull-in coupling (210), said body including a turntable (44) having a horizontal shaft rotatably supported thereon, said connecting means including a torque arm (188') having lower, middle and top portions, said lower portion being rotatably supported on said horizontal shaft, said middle portion of said torque arm (188') rotatably supporting said first end of said arm (150"), said passive damping means coupled between said top portion of said torque arm (188') and said arm (150").

70. The mooring system of claim 69 further comprising an active forcing system coupled between said top portion of said torque arm (188') and said arm (150").

71. In a mooring system for maintaining a vessel at the surface of a body of water in a position in relation to a body which is secured to the bottom of the body of water, where the mooring system includes at least one arm coupled at a first end of the arm to the body, said arm having a second end coupled by connecting means to said vessel, said vessel experiencing oscillation in displacement about a quiescent position in response to environmental conditions of said body of water, an improvement comprising passive damping means for damping said oscillation of said vessel about said quiescent position, said passive damping means being in addition to the damping effect of water acting against the vessel or the arm, whereby magnitude of said oscillation of said vessel is reduced, and wherein said connecting means includes a torsion spring element (514) mounted on said vessel, and a torque actuator (512) is coupled to said torsion spring element (514) and pivotably coupled to said second end of said arm.

72. The mooring system of claim 71 wherein said torque actuator is a passive control hydraulic torque actuator means.

73. The mooring system of claim 71 wherein said torque actuator is a passive elastomeric torque actuator means.

74. The mooring system of claim 71 wherein said torque actuator is a passive disk brake torque actuator means.

75. In a mooring system for maintaining a vessel at the surface of a body of water in a position in relation to a body (10''') which is secured to the bottom of the body of water, where the mooring system includes at least one arm (311) coupled at a first end of the arm to the body (10'''), said arm (311) having a second end coupled to a frame (300) secured to said vessel, said arm having a pendular weight (302) coupled to said frame (300) by means of a tension member (304), said vessel characterized by oscillating displacements about a neutral position in response to environmental conditions of said body of water, said pendular weight (302) providing increasing force to said arm (311) in a direction to move said vessel toward said neutral position as a function of increasing distance that said vessel moves from said neutral position, and where the improvement comprises a damping element (310, 315) coupled between said frame (300) and said arm (311).

76. In a mooring system for maintaining a vessel at the surface of a body of water in a position in relation to a body (10''') which is secured to the bottom of the body of water, where the mooring system includes at least one arm (311) coupled at a first end of the arm to the body (10'''), said arm (311) having a second end coupled to a frame (300) secured to said vessel, said arm having a pendular weight (302) coupled to said frame (300) by means of a tension member (304), said vessel characterized by oscillating displacements about a neutral position in response to environmental conditions of said body of water, said pendular weight (302) providing increasing force to said arm (311) in a direction to move said vessel toward said neutral position as a function of increasing distance that said vessel has moved from said neutral position, an improvement comprising, means for generating a displacement signal representative of displacement of said vessel from said neutral position, and means responsive to said displacement signal for applying a force to said arm in a direction to move said vessel toward said quiescent position.

77. The mooring system of claim 76 wherein said means responsive to said displacement signal includes a first motor driven winch (380) disposed on said vessel and a first flexible tension member coupled between said second end of said arm (311) and a second motor driven winch on said vessel coupled to said second end of said arm (311), by a second flexible tension member via a turning block coupled between said second winch and said vessel.

78. In a mooring system for maintaining a vessel at the surface of a body of water in a position in relation to a body which is secured to the bottom of the water, where the mooring system includes at least one arm coupled at a first end of the arm to the body, said arm having a second end coupled by connecting means to said vessel, said vessel experiencing oscillation of a certain magnitude in displacement about a quiescent position in response to environmental conditions of said body of water, an improvement comprising, coupling said first end of said arm to said body at a vertical position of said body which is at the intersection of a projection of an average roll axis of said vessel on said body.

79. The system of claim 78 wherein said body is a tower and said coupling at said first end of said body is a pivotable connection of a turntable on said tower.

80. The system of claim 79 wherein said connecting means for connecting said second end of said arm includes a damping mechanism.

* * * * *